United States Patent [19]

Machura et al.

[11] Patent Number: 5,055,068

[45] Date of Patent: Oct. 8, 1991

[54] STAMPED AND FORMED COAXIAL CONNECTORS HAVING INSERT-MOLDED CENTER CONDUCTORS

[75] Inventors: Bernard C. Machura, Oak Brook; Eugene J. Mysiak, Lisle, both of Ill.

[73] Assignee: Phoenix Company of Chicago, Inc., Wooddale, Ill.

[21] Appl. No.: 630,020

[22] Filed: Dec. 19, 1990

Related U.S. Application Data

[63] Continuation-in-part of Ser. No. 396,991, Aug. 22, 1989, abandoned.

[51] Int. Cl.[5] ..... H01R 13/00

[52] U.S. Cl. ..... 439/581

[58] Field of Search ..... 439/578-585

[56] References Cited

U.S. PATENT DOCUMENTS

| | | | |
|---|---|---|---|
| 3,156,920 | 11/1984 | Mysiak . | |
| 3,879,103 | 4/1975 | Petola et al. | 439/581 |
| 3,910,665 | 10/1975 | Stull . | |
| 3,915,535 | 10/1975 | O'Keefe et al. . | |
| 3,951,491 | 4/1976 | Mysiak . | |
| 4,029,385 | 6/1977 | Mysiak et al. . | |
| 4,036,545 | 7/1977 | Mysiak et al. . | |
| 4,360,244 | 11/1982 | Forney, Jr. et al. | 439/581 |
| 4,377,321 | 3/1983 | Weisenburger . | |
| 4,412,717 | 11/1983 | Monroe | 439/581 |
| 4,453,796 | 6/1984 | Monroe | 439/581 |
| 4,598,961 | 8/1986 | Cohen . | |
| 4,607,903 | 8/1986 | Hoshino et al. . | |
| 4,611,867 | 9/1986 | Ichimura et al. . | |
| 4,624,525 | 11/1986 | Ichimura et al. . | |
| 4,645,288 | 2/1987 | Stursa . | |
| 4,701,001 | 10/1987 | Verhoeven . | |
| 4,795,352 | 1/1989 | Capp et aal. . | |

FOREIGN PATENT DOCUMENTS

| | | |
|---|---|---|
| 1231403 | 1/1988 | Canada . |
| 0327308 | 8/1989 | European Pat. Off. . |
| 2222768 | 10/1974 | France . |

OTHER PUBLICATIONS

AMP Incorporated, Catalog, "AMPLIMITE Subminiature D Military Connectors", p. 8, Coaxial and Power Contacts for Series 109 Housings with Power/Coax and Signal Mix, pp. 15-19.

Allied Amphenol Products, *Amphenol Industrial Line Connector,* "Amphenol Sub-Miniature Coaxial Connectors", Catalog No. F122-00058, Issue 3/3/86, pp. 92, 118, 192-198.

ITT Cannon, *D Subminiature Rectangular Connectors,* catalog pp. 35, 36, 37, and 44.

FCT Electronic GmbH, *D-Subminiature Mixed Layout Connectors,* Catalog No. ML 1-88, pp. 1, 4, 6, 13, and 15.

General Connector Corporation, *Sub-Rectangular-GM Contacts: Coaxial/Hi-Voltage/Hi-Power,* Catalog 4M 684 R2, pp. 17-20.

Positronic Industries, Inc., *Handbook of International Subminiature-D Connectors,* Catalog, "Industrial and Military Quality Subminiature-D Connectors", pp. 55-64.

Sealectro Corp., *Coaxial Connectors Quick-Reference Catalog,* Catalog QR-6, "Connex Specifications", pp. 3-10, 13, SMA Connectors, pp. 15-17, Nanhoex Connectors, pp. 24-34.

(List continued on next page.)

*Primary Examiner*—Joseph H. McGlynn

*Attorney, Agent, or Firm*—Welsh & Katz, Ltd.

[57] ABSTRACT

Various configurations of straight and right-angle receptacle connectors and plug connectors for connecting a coaxial cable of 75 ohms or greater to a printed circuit board or coaxial cable are disclosed. The receptacle and plug connectors comprise an outer shell member, a dielectric member, and a center conductor. The outer shell members are stamped and formed to maintain a predetermined inside diameter. The center conductors are preferably stamped and formed to maintain an exact but selectable outside diameter determined by the desired characteristic impedance of the connector. The center conductors are subsequently insert molded into the dielectric members during the manufacturing process. The connectors are assembled by inserting the molded dielectric member subassembly into the outer shell.

63 Claims, 19 Drawing Sheets

OTHER PUBLICATIONS

Stetco, Inc. Electronics Company, "HF Coaxial Inserts", pp. 54–61.
Sealectro BICC Electronics, "50 and 75 Ohm Coaxial DIN Inserts", (2 pp.).
Palco Connector, "PDM, PDM-50, PDM-Z/P", Catalog No. 387L5M, pp. 2–6.
The Phoenix Company of Chicago, "D-Subminiature Combination Connectors, Coax Contacts, High Power Contacts, Solderless Contacts", Catalog, pp. 3, 6–9.
Applied Engineering Products, advertisement (1 pp.).
JAE Electronics, Inc., Catalog No. 102, DBML Series Connector, 5 pp.
Hubbard "Specification and Testing of Megahertz Range Coaxial Connectors", *Connection Technology,* Aug. 1989, pp. 19–21.
Morelli, "Coaxial Connector Trend", *Connection Technology,* Mar. 1986, pp. 16–19.
Hirose Electric U.S.A., Inc., *Connection Technology,* Jul., 1988, advertisement, p. 15.
Semflex, Inc., *Connection Technology,* Aug. 1989, advertisement, p. 49.

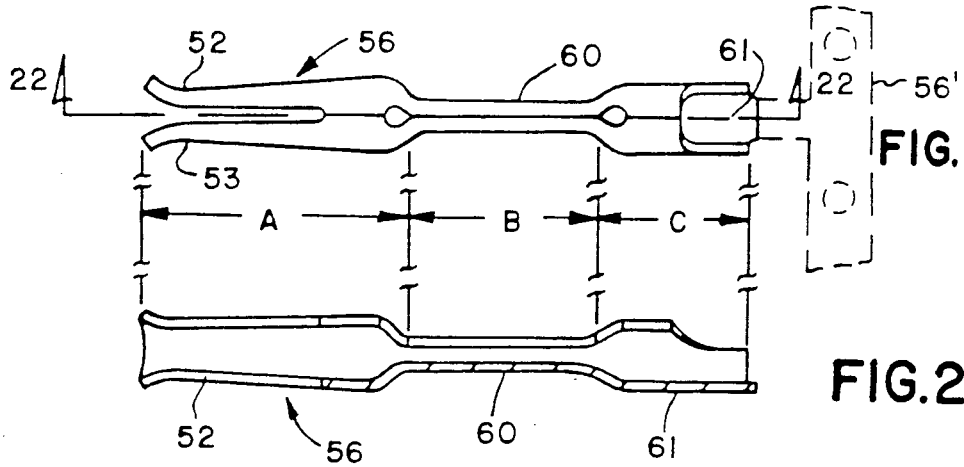
FIG.21
FIG.22
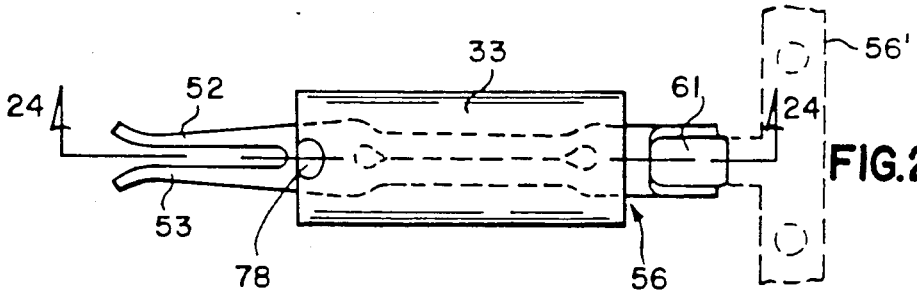
FIG.23
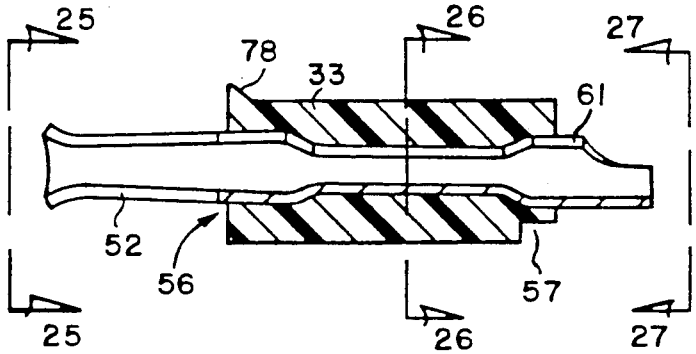
FIG.24
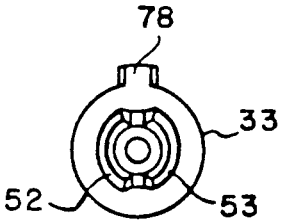
FIG. 25
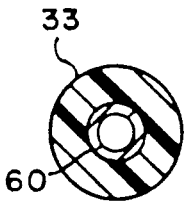
FIG. 26
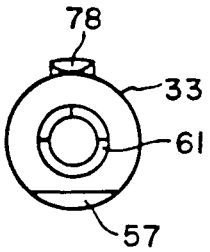
FIG. 27

STAMPED AND FORMED COAXIAL CONNECTORS HAVING INSERT-MOLDED CENTER CONDUCTORS

CROSS REFERENCE TO RELATED APPLICATIONS

This application is a continuation-in-part of application Ser. No. 07/396,991, filed Aug. 22, 1989, now abandoned, entitled "Methods for Making Coaxial Connectors".

FIELD OF THE INVENTION

The invention pertains generally to coaxial connectors, and more particularly to a system for manufacturing coaxial connectors by insert molding the center conductor within a dielectric material prior to assembly of the connector.

BACKGROUND OF THE INVENTION

A coaxial cable is an electrically conducting cable containing two or more conductors, each isolated from the others and running parallel to the others. Generally, such cables have a center conductor embedded in a dielectric, a woven or braided metallic shield surrounding the dielectric, and an outer insulating jacket which surrounds the shield. The center conductor carries a UHF or VHF radio frequency signal, while the braided conductor acts as an electromagnetic shield to prevent interference with the radio frequency signal.

A coaxial connector is a device for connecting a coaxial cable to another coaxial cable or to a different electronic medium, for example, a printed circuit board. In many instances, it is desirable to connect various types of signal conductors to a printed circuit board other than just a coaxial cable. For these cases, combination connectors are used which have both coaxial connectors and pin connectors arranged in an array in the same-connector housing. One of the conventional connectors of this type includes a D-subminiature housing having a female connector (receptacle) mateable with a male connector (plug). Other combination configurations are known, and it is evident that connectors which fit into a combination housing may be used individually for connection. The main function of such coaxial connectors is to provide a reliable and acceptable connection to coaxial cables of a given size.

In addition to providing a reliable and acceptable connection for a coaxial cable, it is another desirable attribute of a coaxial connector to provide for the maintenance of the characteristic impedance of the coaxial cable to which it is connected. In this regard, many previous coaxial connectors have had an upward limit of approximately 50 ohms. This is because the characteristic impedance Z of a connector is dependent upon the outer diameter of the inner conductor and the inner diameter of the outer housing, both of which are relatively fixed. In many instances, the outer housing of a coaxial connector is manufactured by a machining process and such process determines the characteristics of the material from which it is made, i.e., the material must be hard enough to chip during machining, and must be of a particular thickness to withstand the process. Because the outer diameter of such coaxial connectors is generally fixed by convention or standards, this produces a coaxial connector with a limitation on the inner diameter of the outer shell.

Further, many of the center conductors of coaxial connectors are pushed into a bore of a pre-formed dielectric member before assembly to the shell member of the coaxial connector. This process, because of the stiffness required for the center conductor, essentially defines the minimum outer diameter of the inner conductor. This again substantially limits the final impedance of the connector.

However, there are new applications for coaxial connectors which require such terminations to be of significantly higher impedance. For example, in the telecommunications and computer industry, a coaxial connection to a local area network or a telephone line should be terminated at approximately 75 ohms. This would create significant power loss if the standard 50 ohm connector is used.

One particularly advantageous coaxial connector for printed circuit boards is the receptacle end connector which is right-angled to a terminal end that allows a coaxial cable to be connected parallel to the plane of the printed circuit board. Such connectors have been suggested in the prior art, but have been inadequate in providing a low cost, inexpensive connector which can meet the impedance requirements of the present telecommunication and computer industries.

There have additionally been several problems in the manufacturing of coaxial connectors which increase their cost. Many of the coaxial connector shells are produced by a screw machining process which has a number of disadvantages. First, the screw-machined outer shell is inherently constructed of several piece parts which do not lend themselves to further simplified automated handling in the assembly process. Second, it is not readily adaptable between separate sizes of connectors and combination connectors. In fact, it is somewhat difficult to design and assemble separate retention means for the connector shells after they have been made.

Another difficulty is not being able to perform selective plating of contact metals on the connectors. Optimally, one would only plate noble contact metal in the places that the connector made a frictional fit with another connector. The present method is to barrel plate the entire connector shell, because selective plating of individual piece parts is even more expensive. However, significant plating material is wasted in this process.

Moreover, the screw-machined connector does not lend itself to sub-microminiaturization. New connectors will be required for denser circuit arrays in the future, and complete redesigns of the present connectors for materials and sizes will be required for machined connectors. It would be highly advantageous to find a process for making coaxial connectors which could be easily scaled to denser configurations without changing materials, processes, and design parameters.

The material, beryllium copper, which is generally used for making screw-machined connector shells, is relatively expensive and granular in structure. The hardness of the material must be suitable for ease of machining which limits its thickness. The spring finger contacts of a receptacle connector are formed by a secondary slitting or sawing operation on the shell. With this type of shell, it is difficult to calculate the stresses and the normal forces required for the proper contact engagement and the durability of the contact. One must generally rely on the spring properties of expensive beryllium copper and sometimes provide an additional heat treatment operation.

SUMMARY OF THE INVENTION

It is therefore a general object of the present invention to provide improved coaxial cable connectors of simple and inexpensive construction.

It is a further object of the present invention to provide an improved method and system for manufacturing and assembling coaxial cable connectors.

It is another object of the present invention to provide an improved coaxial cable connector, with a receptacle end right-angled to a printed circuit board terminal end, of simple and inexpensive construction.

It is another object of the invention to provide an improved coaxial cable connector, with a plug end and cable termination end, of simple and inexpensive construction.

Still another object of the invention is to provide coaxial connectors which exhibit precise impedance matching over a wide range of frequencies.

Another object of the invention to provide coaxial connectors with increased impedance ratings which can match coaxial cables of 75 ohms or more.

It is yet another object of the invention to reduce the cost of manufacturing coaxial connectors by using the least number of piece parts, the most efficient piece part manufacturing processes, and manufacturing and assembly techniques which are the most compatible with automation.

It is still another object of the invention to provide coaxial connectors, of either the plug or receptacle types, which can alternatively be used alone or in a combination grid.

Another object of the invention is to assure interchangeability of coaxial connectors, of either the plug or receptacle types, with the established standards for the D-subminiature and 41612 DIN combination connector grids (and other geometric parameters) which also qualify for the performance requirements of these standards.

It is yet another object of the invention to manufacture coaxial connectors by a process which can be conveniently adapted to miniaturize VHF/UHF coaxial connectors and/or combination connector to the submicrominiature level, i.e., with a greater density of a 0.050 in. $\times$ 0.050 in. grid size.

In accordance with the invention, a first embodiment provides a coaxial receptacle connector with a receptacle end for connecting a plug-ended coaxial cable to a printed circuit board. Preferably, at the receptacle end, a spring contact receiver means is provided for resiliently retaining the plug end of the coaxial cable, and at the other end, a three-legged terminal configuration for solder connection to a printed circuit board is provided. The receiver means is right-angled to the terminal end to allow the coaxial cable to be mounted parallel to the plane of the printed circuit board.

In a preferred implementation, the receptacle connector comprises a stamped and formed outer shell member, a dielectric member, and an insert-molded right angle center conductor. The outer shell member is stamped and formed to maintain an exact inside diameter to the shell. Integral with the outer shell are retaining means which permit the connector to be mounted in a combination housing. The center conductor is machined to maintain an exact but variable outside diameter. The center conductor is subsequently insert molded into the dielectric member. The dielectric member is then assembled into the stamped and formed shell member which has locating means for a positive positioning between the shell and dielectric member.

In accordance with the invention, a second embodiment provides a coaxial plug connector with a plug end for connecting to the receptacle connector and a coaxial end for connecting to a coaxial cable. The plug end mates resiliently with the receiver portion of the receptacle connector, and the coaxial end comprises a solder cup and shield retaining means for connection to the coaxial cable.

In one implementation, the plug connector comprises a stamped and formed outer shell member, a dielectric member, and an insert-molded center conductor. The outer shell member is stamped nd formed to maintain an exact inside diameter to the shell Integral with the outer shell are retaining means which permit the connector to be mounted in a combination housing. The center conductor is stamped and formed to maintain an exact but selectable outside diameter. The center conductor is subsequently insert molded into the dielectric member. The connector is then assembled with the formed shell around the dielectric member which has locating means for a positive positioning between the shell and dielectric member.

Further embodiments of the invention are also provided, which include various elements of the three-leg right-angle printed circuit mount coaxial receptacle connector embodiment and the cable soldered and crimped straight coaxial plug connector embodiment. Specifically, the present invention includes the following additional embodiments: a five-leg right-angle printed circuit mounted coaxial receptacle connector; a cable soldered and crimped right-angle coaxial receptacle connector; a three-leg straight printed circuit mounted coaxial receptacle connector; a five-leg straight printed circuit mounted coaxial receptacle connector; a three-leg right-angle printed circuit mounted plug connector; a five-leg right-angle printed circuit mounted plug connector; a three-leg straight printed circuit mounted plug connector; a five-leg straight printed circuit mounted plug connector; a cable soldered and crimped straight coaxial receptacle connector; and a cable soldered and crimped right-angle coaxial plug connector.

According to a further aspect of the present invention, a system for manufacturing a coaxial connector is provided, wherein the system comprises: a station for pre-plating a center conductor blank on a carrier, a stamping station for defining the outline of the center conductor blank, a forming station for forming the center conductor from the blank, wherein the tip portion of the center conductor has a predetermined shape, and wherein the center conductor has a middle body portion. Once the center conductor is provided, it is inserted into a molding station wherein a dielectric member of a predetermined form is molded around at least the middle body portion of the center conductor, thereby providing a inner subassembly. The system further includes a stamping station for stamping the outer shell blank received on a carrier, a partial forming station for forming the outer shell such that at least a portion of it has a tubular shape, a selective plating station for selectively plating the front and rear tubular portions of the shell, and a cutting and forming station for cutting the center and rear carriers of the shell. Finally, the inner subassembly is inserted within the tubular-shaped portion of the outer shell in an insertion station, thereby forming the coaxial connector. In the case of a right-angle connector, a final forming station is used to bend the tail portions of the outer shell around the base portion of the dielectric member.

The stamping and forming process provides a facile method for precisely matching a desired impedance. In these processes, the inner diameter of the shell and the outer diameter of the inner conductor can be maintained to very close tolerances. By keeping the inner diameter of the outer shell constant and by varying the outer diameter of the inner conductor, precise impedance matching over a wide range of values is possible.

Moreover, because of the material used for the outer shell and its unitary design, the inner diameter of the outer shell can be increased while still retaining a standard outside diameter. Because the inner conductor is insert molded, a much thinner conductor can be used thereby reducing its outer diameter. Both of these factors contribute to the ability to increase the impedance ratings of coaxial connectors to 75 ohms or more, while meeting other standard design parameters.

The manufacturing process and the design of the connectors lend themselves to an inexpensive assembly process which has a reduced number of piece parts to handle and which is adaptable to automation. The number of piece parts for assembly has been reduced to two, the outer shell and the dielectric member/center conductor subassembly. The separate functional elements for contact, retention, and termination are integrally formed in one of the parts, the outer shell.

The stamping and forming processes, using the center conductor and the outer shell cut from a metal blank, are low cost operations which permit selective plating or even pre-plating with noble contact metals only where they are needed. The process further permits the pieces to be attached to carriers which can position and move a multiplicity of piece parts simultaneously for automated assembly. The stamping, forming, and molding processes also allow a miniaturization of the connectors by scaling down sizes and thicknesses without significant changes in the design or assembling process. Thus, greater densities to the sub-microminiature level can be achieved while retaining the advantages of the low cost assembly and production processes. The sub-microminiature size can also be rated at 50 ohms, or greater, to operate at the GHz level with precise impedance matching.

The stamping process additionally provides a convenient and inexpensive technique for combining stiffening ribs with the terminal legs of the coaxial connectors. These ribs, which are formed integrally with the outer shell, are extremely advantageous in that they produce enough stiffness in the small cross-section of the terminal legs to withstand an automated or a robotic assembling process without bending or misaligning. Such compatibility with automated handling equipment permits the connectors to be manufactured with terminals for either through-hole or surface mounting techniques on printed circuit boards.

BRIEF DESCRIPTION OF THE DRAWINGS

These and other objects, features, and aspects of the invention will become clearer and more fully understood when the following detailed description is read in conjunction with the appended drawings wherein:

FIG. 21 is a top view of the center conductor of the plug connector of FIG. 1;

FIG. 22 is a cross-sectional side view of the center conductor taken along view lines 22—22 in FIG. 21;

FIG. 23 is a top view of the center conductor and dielectric member subassembly;

FIG. 24 is a cross-sectional side view of the center conductor and dielectric member subassembly taken along view lines 24—24 in FIG. 23;

FIG. 25 is a front view of the center conductor and dielectric member subassembly taken along view lines 25—25 in FIG. 24;

FIG. 26 is a cross-sectional front view of the center conductor and dielectric member subassembly taken along view lines 26—26 in FIG. 24;

FIG. 27 is an end view of the center conductor and dielectric member subassembly taken along view lines 27—27 in FIG. 24;

DETAILED DESCRIPTION OF THE PREFERRED EMBODIMENTS

Figure 1:
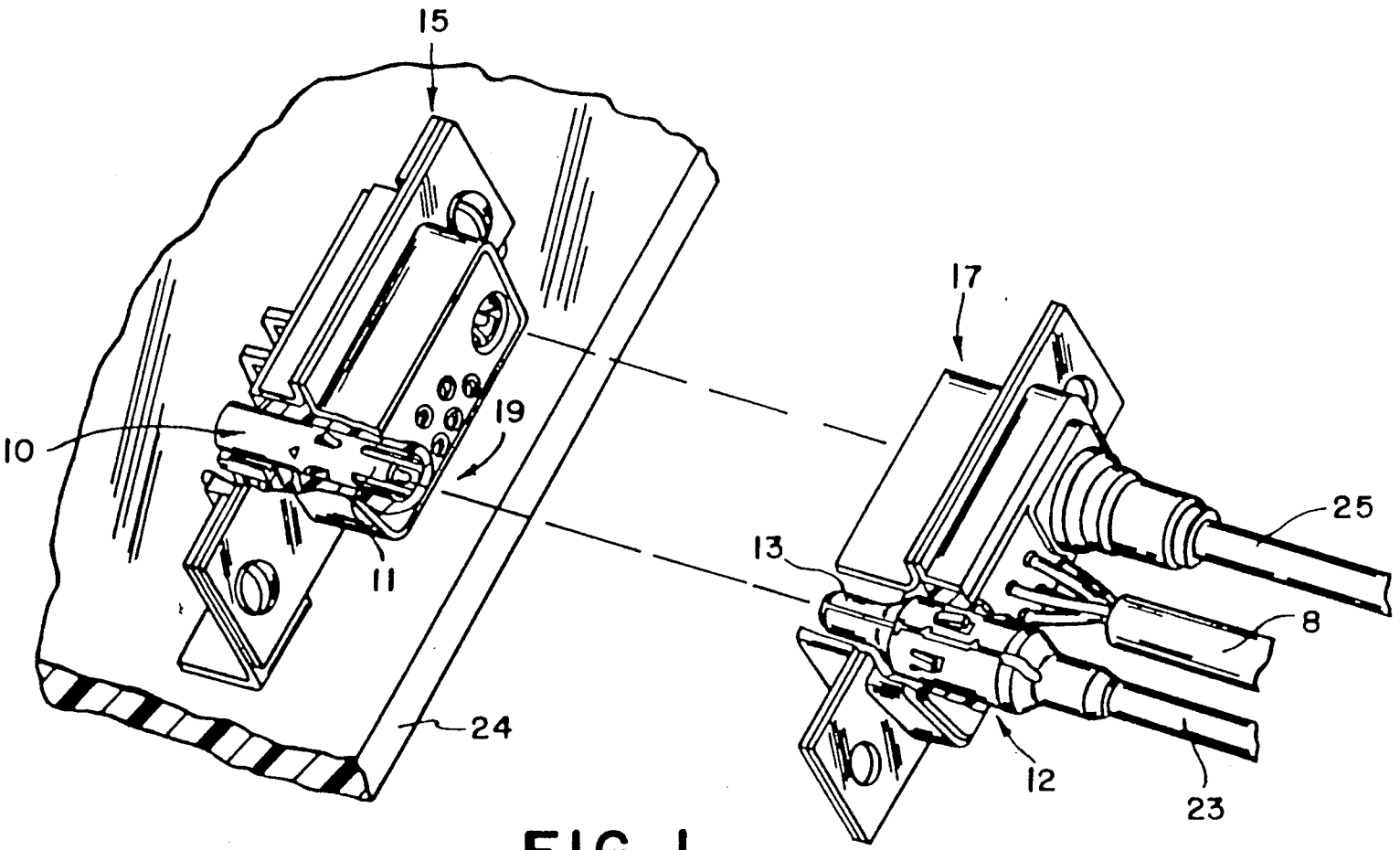
FIG. 1 is a perspective view, partially fragmented, illustrating a receptacle connector and a plug connector each of which is mounted in a combination connector housing.

A coaxial receptacle connector 10 and coaxial plug connector 12 constructed in accordance with the invention are shown in FIG. 1. The receptacle connector 10 has a receiver means 11 adapted to mate with a plug means 13 of the plug connector 12. The connectors 10 and 12 are illustrated as inserted in connector bores of combination housings 15 and 17, respectively. The combination housings 15, 17 are of the subminiature D category and include spaces for several of the coaxial connectors 10, 12 and conventional pin contacts 19. Only one configuration of combination connector, a conventional D-subminiature, has been illustrated for ease of explanation of the invention. The connectors 10, 12 may, however, be used in any of the standard combination connector configurations including the DIN 41612 combination connector, D-microminiature combination connector, or even as stand along connectors.

The combination housing 15 is affixed to a printed circuit board 24, while combination housing 17 electrically connects to coaxial cables 23 and 25 and multiple wire cable 8 having single conductor wires. The coaxial cable 23 is, therefore, connected to the printed circuit board 24 by mating the combination housings 15 and 17 together which, as a consequence, plugs the plug connector 12 into the receptacle connector 10.

Figure 2:
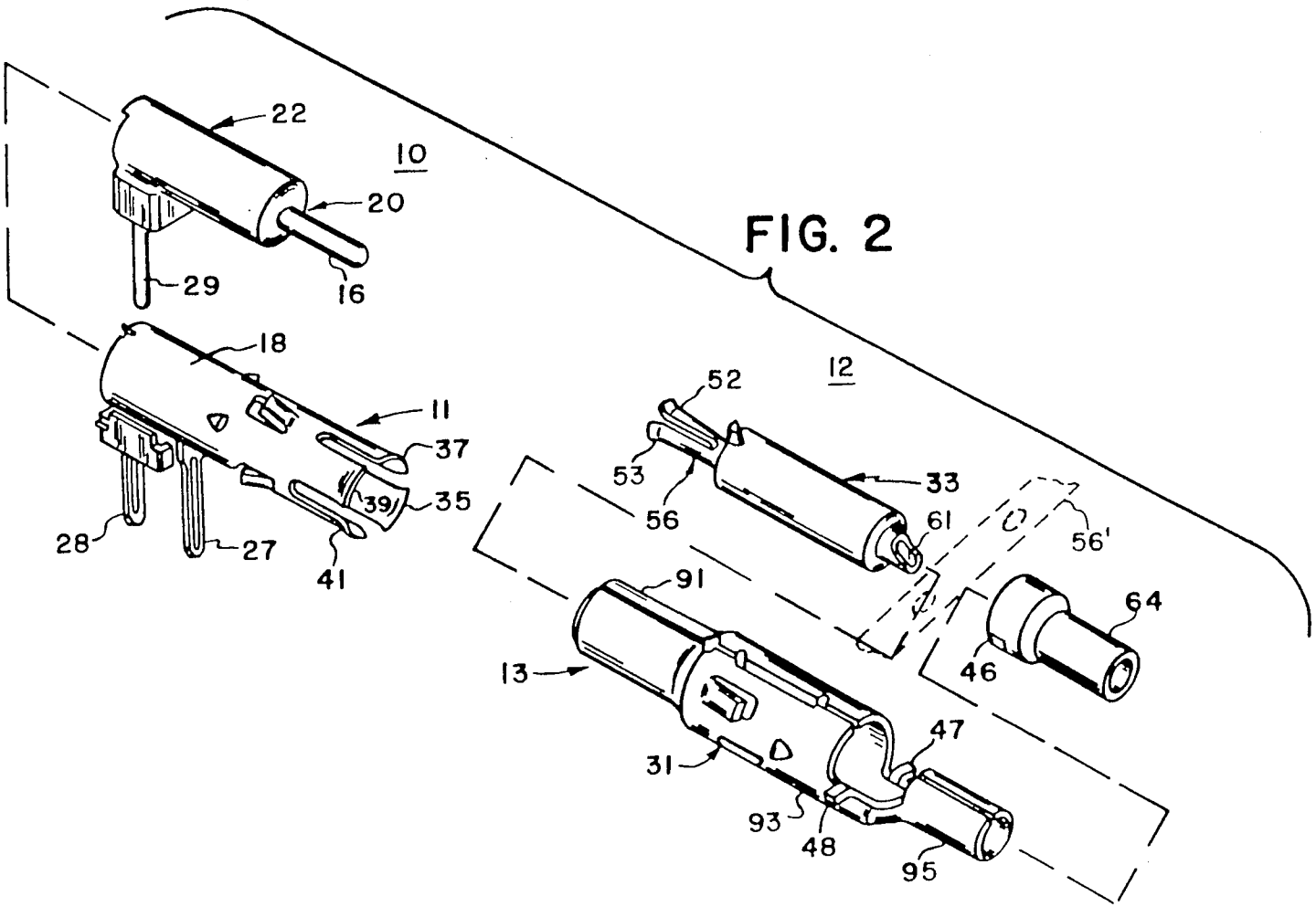
FIG. 2 is an exploded perspective view of the components of the receptacle connector and the plug connector illustrated in FIG. 1.
Figure 3:
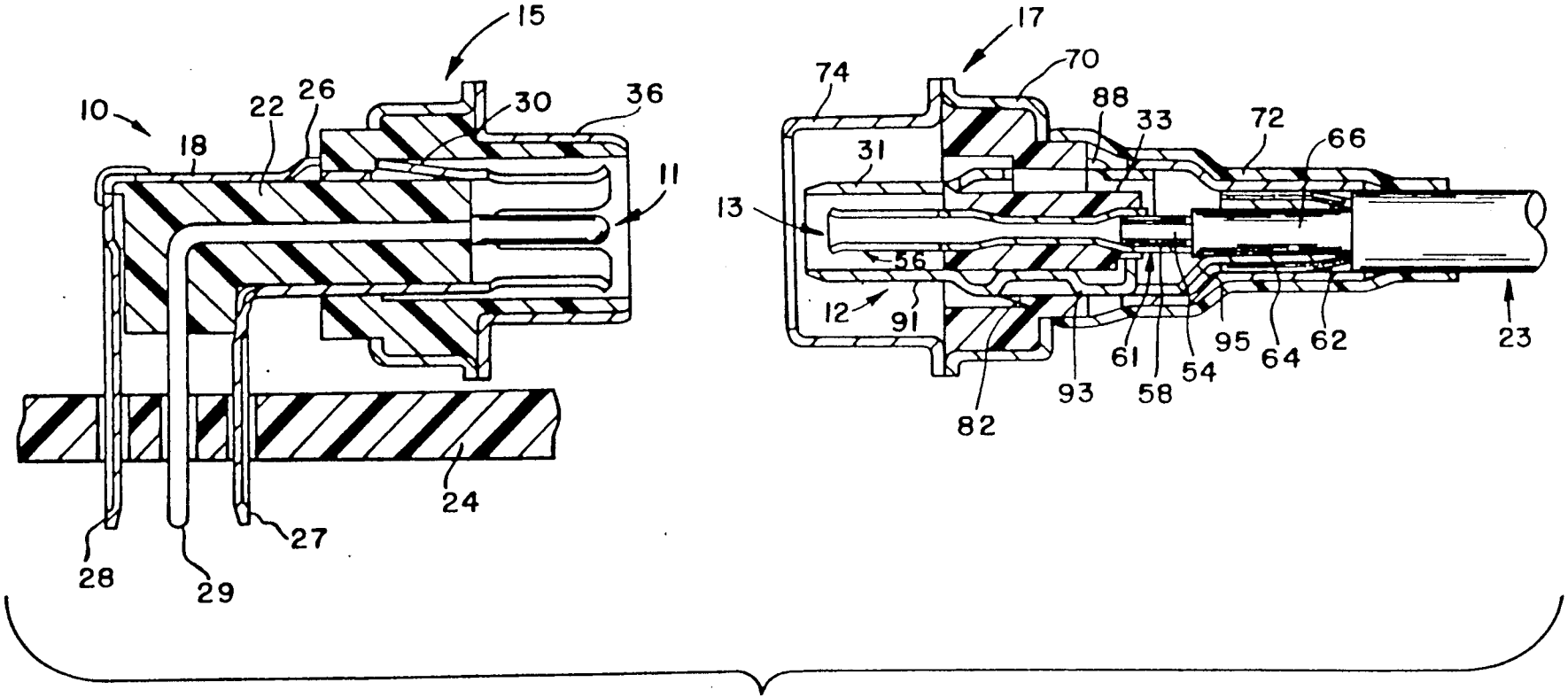
FIG. 3 is a cross-sectional view of the receptacle connector and the plug connector illustrated in FIG. 1.
Figure 4:
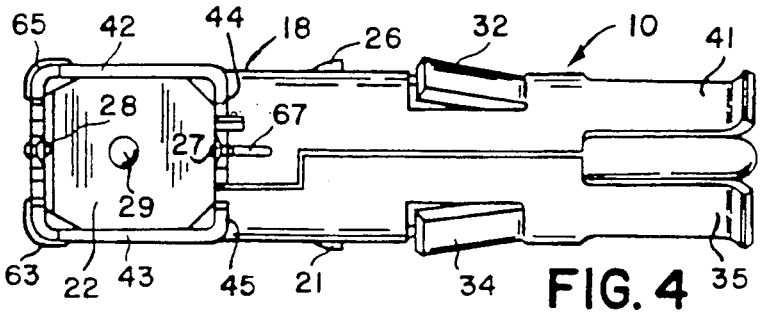
FIG. 4 is a bottom view of the receptacle connector illustrated in FIG. 1.
Figure 5:
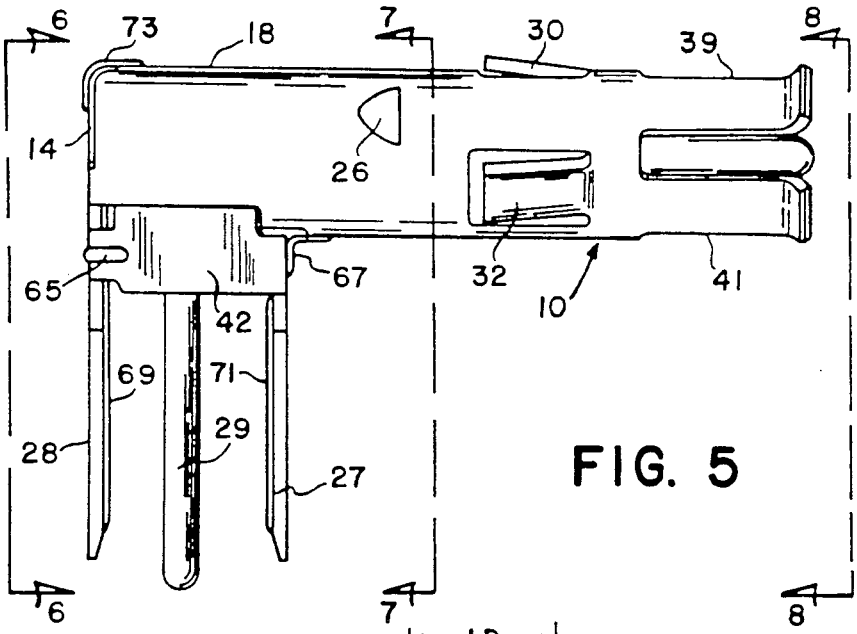
FIG. 5 is a side view of the receptacle connector illustrated in FIG. 1.

Exploded and cross-sectional views of the receptacle connector 10 and the plug connector 12 are shown in FIGS. 2 and 3, respectively. With reference to FIG. 2, the receptacle connector 10 comprises an outer shell member 18, a dielectric member 22, and a center conductor member 20. As will be more fully explained hereinafter, the outer shell member 18 is metallic and is stamped and formed from a suitable strip of metal having a desirable spring characteristic and includes the receiver means 11 with four spring-like finger contacts 35, 37, 39 and 41, a tubular body section, and a terminal section right-angled to the body. A center conductor terminal 29 and front and rear terminal legs 27 and 28 of the terminal section are disposed within through-holes of a printed circuit board 24 for solder connection. The terminal legs 27, 28 are soldered in a ground path, and the conductor terminal 29 is soldered to a signal carrying conductor of the printed circuit board 24.

The dielectric member 22 is molded from a suitable insulative and dielectric material, preferably Teflon or some other polyfluoro plastic, and retains the center conductor centered therein when it is molded. A contact or prong 16 of the center conductor 20 extends from the dielectric member 22 forming a signal conduction path for the receptacle connector in the receiver means 11. The conductor terminal 29 of the center conductor 20, the front terminal leg 27, and the rear terminal leg 28 form the three-leg terminal section for connection to the printed circuit board 24. The center conductor 20, shown as a screw-machined loose part, can alternatively be stamped and formed from a preplated strip on a carrier. This alternative will reduce the cost of manufacture and allow selective plating, as well as provide a fabrication which is suitable to produce a leg for surface mounting.

The plug connector 12 similarly comprises an outer shell 31, a dielectric member 33, a center conductor 56, and ferrule 64. The outer shell 31 is metallic and is stamped and formed from a suitable metal sheet, similarly to the shell 18. The dielectric member 33 is molded from a suitable dielectric and insulative material, preferably Teflon. The center conductor 56 is stamped and formed on a carrier 56' and insert molded into the dielectric member 33 which retains it centered therein. The ferrule 64 is stamped and formed from a metallic sheet and provides a means for retaining coaxial shield 62.

The center conductor 56 includes a fork-shaped receiver having times 52, 53 and a solder cup 61. The outer shell 31 comprises a front tubular portion 91 for contact with the contacts 35, 37, 39, 41 of the receptacle connector 10, a middle body portion 93 for generating a characteristic impedance for the connector in combination with the dielectric member 33, and a rear tubular portion 95 for connection to the coaxial cable 23. The middle body portion has ferrule tabs 47 and 48 which mate with slots 46 in the ferrule 64 to stop it at a predetermined position over the rear tubular portion 95.

As shown cross-sectionally in FIG. 3, the receptacle connector 10 is electrically mateable with the complimentary plug connector 12 when the combination housings 15, 17 are brought together. The receptacle connector 10 includes the center conductor 20 which electrically connects the center conductors 56 of the plug connector 12 to the printed circuit board 24. The center conductor 20 comprises a prong 16 with an elongated connection surface, a right-angle conductor body portion, and a conductor terminal 29. The conductor terminal 29 and front and rear terminal legs 27 and 28 of the terminal section are disposed within through-holes of the printed circuit board 24 for solder connection. The terminal legs 27, 28 are soldered in a ground path and the conductor terminal 29 is soldered to a signal carrying conductor of the printed circuit board 24.

The receptacle connector is mounted in the combination housing 15 which is counter bored. The shoulder of the first bore retains the outer shell 18 in the housing by latches 30 which spring outwardly against the shoulder. The latches 30 work in combination with stops 26 in the surface of the outer shell 18 and with the shoulder of the counterbore to positively retain the connector 10 in place. The housing 15 is covered with a metallic shield which includes a front shield 36.

The plug connector 12 includes the center conductor 56 which electrically connects the signal conductor 54 of the coaxial cable 23 to the center conductor 20 of the receptacle connector 10. The center conductor 56 is generally tubular in shape and comprises at one end a solder cup 61 which receives the signal conductor 54 and solder 58, and at the other end, has a connection means including at least two fork-shaped resilient tines 52, 53 which flexibly receive the prong 16 of the center conductor 20. The center conductor 56 is mounted concentrically in a bore of the dielectric member 33 which is close fitted and stopped in the central chamber of the outer shell 31 by a stop 88.

The outer shell 31 comprises a front tube 91 which surrounds the center conductor 56 and is resiliently received in the contact fingers of the receptacle connector 10. The front tube 91 of the shell 31 is connected to a rear tube 95 by a middle body portion 93 which is substantially U-shaped in cross-section. The inner dielectric insulation 66 of the coaxial cable 23 is received in the rear tube 95 and the solder 58 applied to the center conductor 54 through the gap of the middle body portion. The braided shield 62 of the coaxial cable 23 is pulled over the rear tube 95 to electrically connect the outer shell 31 to the ground potential of the braided shield 62. The braided shield 62 is held in place on the rear tube by crimping the ferrule 64 around the tube.

The plug connector 12 is mounted in the housing 17 which is counterbored. The shoulder of the first bore retains the outer shell 31 in the housing 17 by latches 82 which spring outwardly against the shoulder. The latches work in combination with stops 88 in the surface of the outer shell 31 and the shoulder of the counter bore to positively retain the connector in place. The housing 17 is covered with a metallic shield which includes a front shield 74, which frictionally slips over the shield 36 of the housing 15 of the receptacle connector 10, and a rear shield 70. If desired, an insulative piece of shrink tubing 72 can be slipped over the plug connector 12 and the outer jacket of the coaxial cable 23.

When mated, the tines 52, 53 of the inner conductor 56 resiliently receive the prong 16 to electrically connect the signal conductor 54 of the coaxial cable 23 to the signal terminal of the printed circuit board 24 through center conductor 20. The front tube 91 of the outer shell 31 is resiliently held by spring contact fingers 35, 37, 39, 41 of the outer shell 18 to electrically connect the braided shield 62 of the coaxial cable 23 to the ground terminals of the printed circuit board 24 through shells 18 and 31. The ground shield 74 resiliently receives ground shield 36 to electrically connect the shield 74 of the plug connector 12 to the shield 36 of the receptacle connector 10.

Therefore, a coaxial receptacle connector 10 right-angled to a printed circuit board terminal has been disclosed. The receptacle connector is readily mounted into and electrically connected to the signal and ground conductive paths of a printed circuit board and is electrically mateable with the coaxial plug connector 12 which terminates a coaxial cable. Further, a coaxial plug connector 12 which readily connects to the ground and signal paths of a coaxial cable has been disclosed. The coaxial plug connector 12 is electronically mateable with the receptacle connector 10 which connects at a printed circuit board 24.

FIGS. 4–15 illustrate specific features of the coaxial receptacle connector 10. In the bottom and side views of FIGS. 4 and 5, it is disclosed that the receptacle connector 10 includes a set of relieved portions with bent out latches 30, 32, and 34. These latches are spaced equally at 120° increments around the barrel of the body portion of the connector 10 to form the retaining means for the connector 10 in the combination housing 15. The body portion of the coaxial connector 10 further has a end cover 14, better seen in FIG. 6, which folds over the rear of the molded dielectric member 22, and a portion of which forms the rear terminal leg 28 of the terminal section. The foldable end cover 14 also contains a pair of side flaps 42, 43 which are bendable around the base of the molded dielectric member and which end in resilient tabs 44, 45, to positively retain the base of the dielectric member 22.

Figure 6:
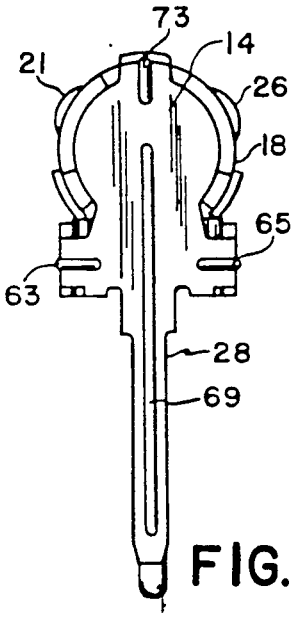
FIG. 6 is an end view of the receptacle connector taken along view lines 6—6 in FIG. 5.
Figure 7:
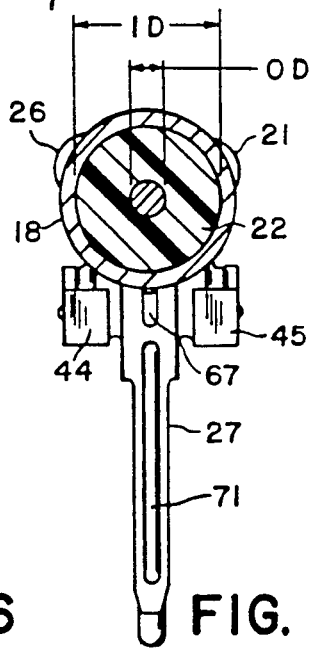
FIG. 7 is a cross-sectional front view of the receptacle connector taken along view lines 7—7 in FIG. 5.
Figure 8:
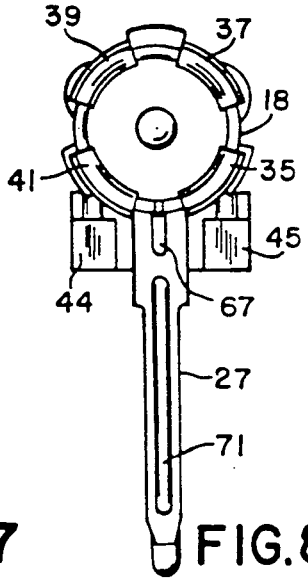
FIG. 8 is a front view of the receptacle connector taken along view lines 8—8 in FIG. 5.

As better illustrated in FIGS. 6–8, the bendable portions and terminal legs 27, 28 of the outer shell 18 are reinforced with ribs 63, 65, 67, 69, 71, and 73 to make them stiffer and stronger, especially during the manufacturing and assembly process. The end cover 14, which is bent over the molded dielectric member 22, has a stiffener rib 73 at the bend. Both terminal legs 27, 28 have stiffener ribs 71 and 69, particularly shown in the end and cross-sectional views, which provide reinforcement for mounting in printed circuit boards. The bendable side flaps 42 and 43 are reinforced by ribs 63 and 65 at their bending portions. The front terminal leg 27 is additionally reinforced with a stiffener rib 67 where it is bent into place.

Figure 9:
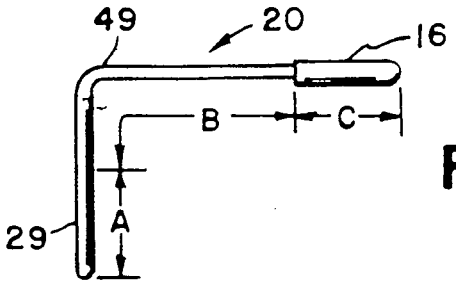
FIG. 9 is a side view of the center conductor for a receptacle connector having maximum impedance.
Figure 10:
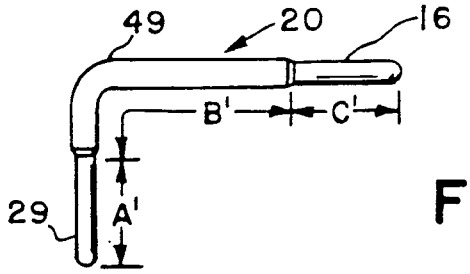
FIG. 10 is a side view of the center conductor for a receptacle connector having minimum impedance.
Figure 11:
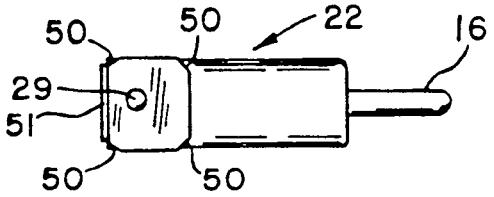
FIG. 11 is a bottom view of the dielectric member with a center conductor insert molded therein.
Figure 12:
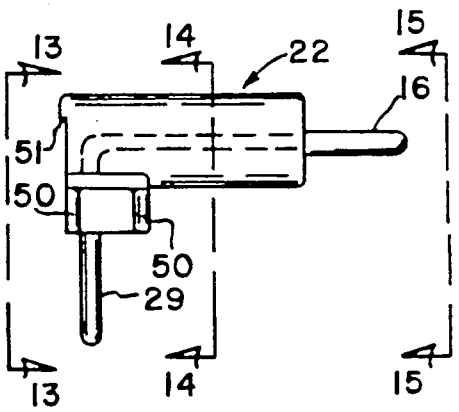
FIG. 12 is a side view of the dielectric member subassembly illustrated in FIG. 11.
Figure 13:
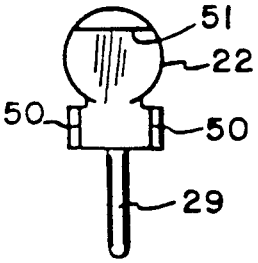
FIG. 13 is an end view of the dielectric member subassembly taken along view lines 13—13 in FIG. 12.
Figure 14:
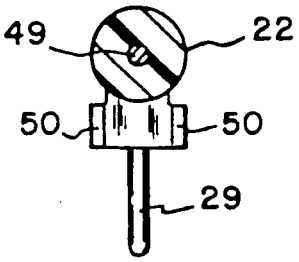
FIG. 14 is a cross-sectional front view of the dielectric member subassembly taken along view lines 14—14 in FIG. 12.
Figure 15:
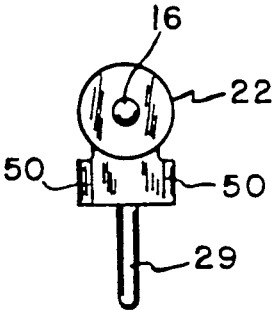
FIG. 15 is a front view of the dielectric member subassembly taken along view lines 15—15 in FIG. 12.

FIGS. 9–15 more clearly disclose the configuration and structure of the molded dielectric member 22 and center conductor 20. FIGS. 9 and 10 illustrate the configurations available for the center conductor 20. The center conductor 20 of FIG. 9 comprises three parts, including a standard-sized contact prong 16 of length C, a middle conductor body portion 49 of length B, and a standard-sized conductor leg or terminal 29 of length A. The center conductor 20 of FIG. 10 has corresponding parts 16 of length C', 49 of length B', and 16 of length A', where A=A', B=B', and C=C'. The difference between the two is the variation in the diameter of the middle conductor body portions 49.

The center conductor 20 preferably is stamped and formed on a carrier (such as 56' of FIG. 21) into a straight pin which produces the conductor body 49 with a range of outside diameters to exhibit a particular or desired impedance which matches with a specifically-sized coaxial cable. The stamped and formed center conductor 20 is lower in cost to manufacture, can be selectively plated or even pre-plated on a strip, and is easily automated. FIG. 9 illustrates the minimum size for the larger (or higher) impedance, and FIG. 10 illustrates the maximum size for the lower impedance. The prong 16 of both embodiments is of a specified diameter to mate with the standard contact tines 52, 53 of the center conductor 56 of the plug connector 12. A third diameter is used for the conductor terminal 29 and is sized for a conventional through hole of the printed circuit board 24.

After being stamped and partially formed, the center conductor 20 is bent at a right angle and then inserted into a mold for forming the dielectric member 22. A standard molding process using injection grade Teflon is used to make the dielectric member 22. The dielectric member 22 consists of a body which is generally cylindrically shaped and mounted on a base through relieved portions. The dielectric member 22 is also provided with a relieved back portion 51 to improve the formability of the rear terminal leg 28 of the outer shell 18. The base of the dielectric member 22 is generally rectangular, and includes fillet portions 50 which assist in the bending of the shell 18 around the member 22 during the formation process.

An equation for determining the characteristic impedance of a coaxial receptacle connector of this configuration is given by:

$$Z_r = \frac{C_1}{\sqrt{E_r}} \log \frac{I.D._r}{O.D._r}$$

where $Z_r$=the desired characteristic impedance of the receptacle connector 10 (in ohms);

$C_1$=a predetermined constant, (138)

$E_r$=the dielectric constant of member 22, (Teflon =2.03);

$I.D._r$=the inner diameter of receptacle outer shell 18 (in inches); and $O.D._r$=the outer diameter of the middle body portion 49 of the receptacle center conductor 20 (in inches).

For an exemplary receptacle connector 10 with a precision impedance of 75 ohms, the inner diameter of the outer shell 18 would be 0.1575 inches and the outer diameter of the middle body portion 49 of the center conductor 20 would be 0.026 inches. Note that the outer diameter of the prong portion 16 is 0.040 inches, which is substantially greater than 0.026 inches. This gives an I.D./O.D. ratio of approximately 6.0 for a 75 ohm connector. This produces a high impedance connector which is suitable for the new uses of coaxial connectors in the computer and telecommunications industries. If the 60 ohm European standard is required, then a center conductor having an O.D. of 0.037 inches would give an I.D./O.D. ratio of 4.2. Similarly, a U.S. standard 50 ohm connector, having a center conductor O.D. of 0.047 inches, would provide a ratio of 3.3 using the same outer shell. It is evident that even higher impedance connectors are possible, because the molding process makes the use of very small center conductors feasible.

Moreover, because of the stamping, forming, and molding operations of the invention, these dimensional values can be held to precise tolerances. These processes can be controlled to produce tolerances within ±0.001 of an inch, which yields precision impedance matching within ±0.035 ohms for the 75 ohm connector described.

Figure 16:
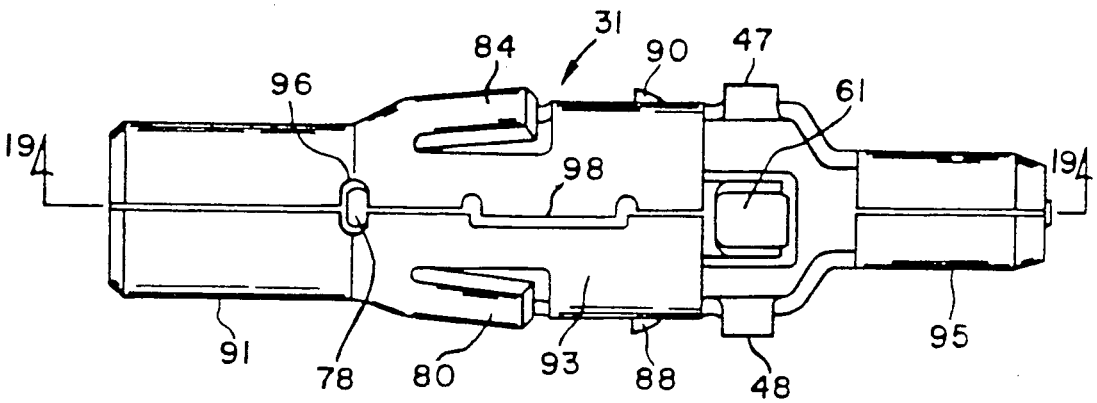
FIG. 16 is a top view of the plug connector illustrated in FIG. 1.
Figure 17:
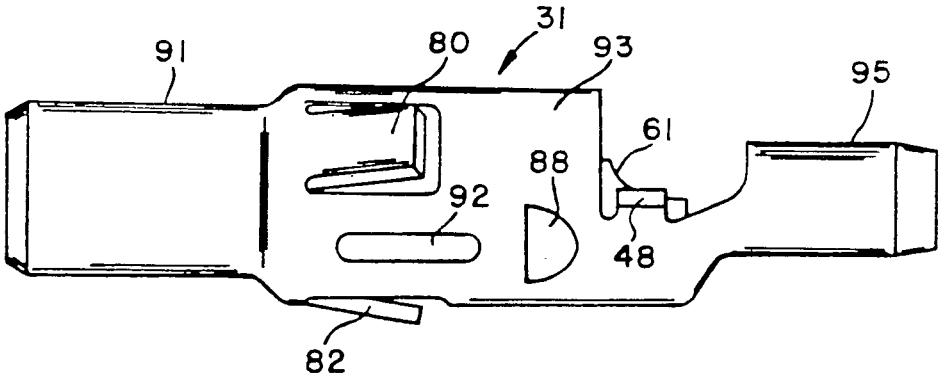
FIG. 17 is a side view of the plug connector illustrated in FIG. 1.
Figure 18:
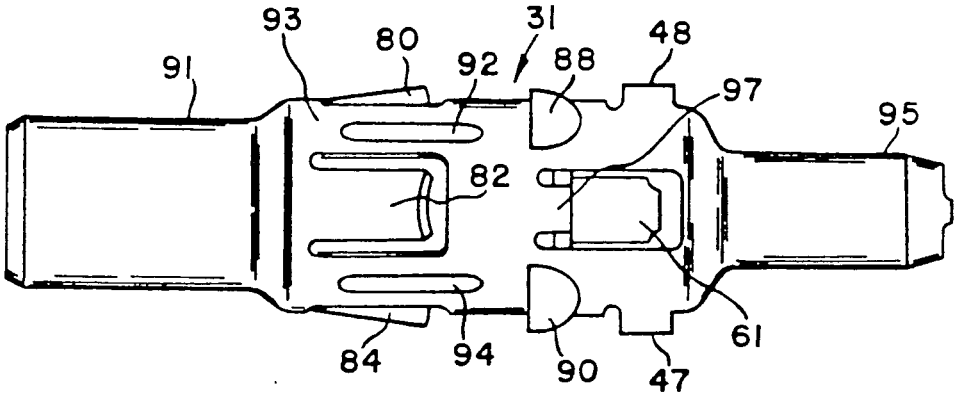
FIG. 18 is a bottom view of the plug connector illustrated in FIG. 1.

The specific features of the plug connector 12 are more clearly shown in FIGS. 16–27. FIGS. 16, 17, and 18, which illustrate top, side, and bottom views, respectively, of the plug connector 12, disclose that the outer shell 31 of the plug connector 12 is folded around the inner dielectric member 33 (see FIG. 19) which contains the center conductor 56. The outer shell 31 comprises the front tubular member 91, which is connected to the rear tubular member 95 by the central cup-shaped body member 93. The front tubular member 91 becomes the plug means 13 which is received into the receiver means 11 of the receptacle connector 10. The rear tubular member 95 accepts the inner insulator 66 of the coaxial cable 23 (see FIG. 3) to provide strain relief, while the body member 93 of the outer shell provides access to the solder cup 61 of the center conductor 56 such that the signal conductor 54 (see FIG. 3) of the coaxial cable 23 may be soldered thereto. The outer shell 31 includes three spring latches 80, 82, and 84 spaced at 120° increments around the periphery of the outer shell. Designed to act in concert with the latches 80, 82, and 84 are two cowl-shaped stops 88 and 90, each located between two of the latches. The latches and stops locate and retain the plug connector 12 centered in the contact bore of the combination housing 17.

Figure 19:
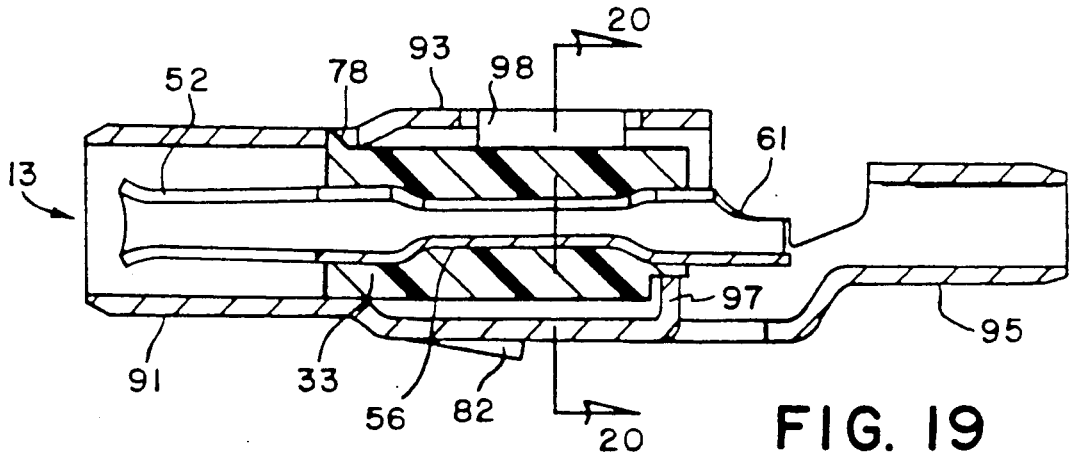
FIG. 19 is a cross-sectional side view of the plug connector taken along view lines 19—19 in FIG. 16.
Figure 20:
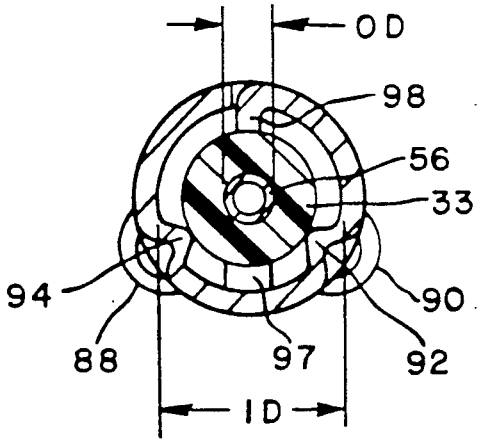
FIG. 20 is a cross-sectional front view of the plug connector taken along view lines 20—20 in FIG. 19.

FIG. 19 and FIG. 20, which are cross-sectional views of the plug connector illustrated in FIG. 16–18, more clearly disclose that the dielectric member 33 and center conductor 56 combination are supported by the spacing means such that the inner surface of the outer shell body 93 and the outer surface of the dielectric member 33 define a generally annular air space about the dielectric member 33. The spacing means, including indents 92, 94 and a spacing tab 98, form means which are elongated along the central axis of the dielectric member 33 in equal angular increments. The dielectric 33 is stopped in a forward manner by a horn 78 and in a rearward manner by a retaining tab 97 which is bent upwardly.

FIGS. 21 and 22 show a top and a cross-sectional side view, respectively, of the center conductor 56 of the plug connector 12. The center conductor 56, which may be stamped from a flat metallic sheet and formed on a carrier 56' into the configuration illustrated, includes a front fork-shaped connecting portion of length A having the two resilient tines 52, 53, a generally cylindrical middle conductor body portion 60 of length B, and a rear solder cup portion 61 of length C. The front connecting portion is generally of a standard configuration and size for receiving the prong 16 of the receptacle connector 10. The solder cup 61 is generally of a standard configuration and size for receiving the signal conductor of a coaxial cable of a predetermined impedance. The diameter of the connector body is used to vary the impedance of the connector by having a selectable outside diameter connecting the two standard end pieces of the center conductor 56.

The characteristic impedance of the plug connector 12 is given by the equation:

$$Z_p = \frac{C_2}{\sqrt{E_c}} \log \frac{I.D._p}{O.D._p}$$

where $Z_p$ = the desired impedance of the plug connector 12 (in ohms);

$C_2$ = a predetermined constant, (138)

$E_c$ = the combined dielectric constant of air and dielectric member 33;

$I.D._p$ = the inner diameter of the plug outer shell 31 (in inches); and $O.D._p$ = the outer diameter of the middle body portion 60 of the plug center conductor 56 (in inches).

For an exemplary plug connector 12 with a precision impedance of 75 ohms, the inner diameter of the outer shell 31 would be 0.1575 inches, and the outer diameter of the middle body portion of the center conductor 56 would depend upon the combined dielectric constant $E_c$. If no air gap is used, the outer diameter of the middle body portion 60 of center conductor 56 would be the same as that of the receptacle connector center conductor 20, i.e., 0.026 inches. However, the air gap allows a larger outer diameter center conductor to be used, and the middle body portion 60 of the center conductor 56 can be expanded to 0.032 inches when a dielectric member 33 having an outside diameter of 0.123 inches is used, i.e., an air gap of 0.0345 inches.

Moreover, because of the stamping, forming, and molding operations of the invention, these values can be held to precise tolerances. These processes can be controlled to produce tolerances within +0.001 of an inch, which yields precision impedance matching within ±0.035 ohms for the 75 ohm connector described.

In FIGS. 23 and 24, the center conductor 56 on a carrier 56' is shown insert molded into the dielectric member 33, which is generally cylindrical in shape but which includes two locating means, including a horn 78 for front positioning and a notch 57 cut in the rear of the dielectric member for rearward positioning.

FIG. 25 is a front view taken along view lines 25—25 of FIG. 24, illustrating the projection of the connecting means from the cylindrical dielectric member 33. FIG. 26 is a cross-sectional view taken along view lines 26—26 of FIG. 24, illustrating the cylindrical relationship of the middle conductor body portion 60 and dielectric member 33 at the point which contributes to the generalized impedance equation. FIG. 27 illustrates a rear view of the connector taken along lines 27—27 of FIG. 24, illustrating the solder cup 61 and retention notch 57 of the dielectric member 33.

Figure 28:
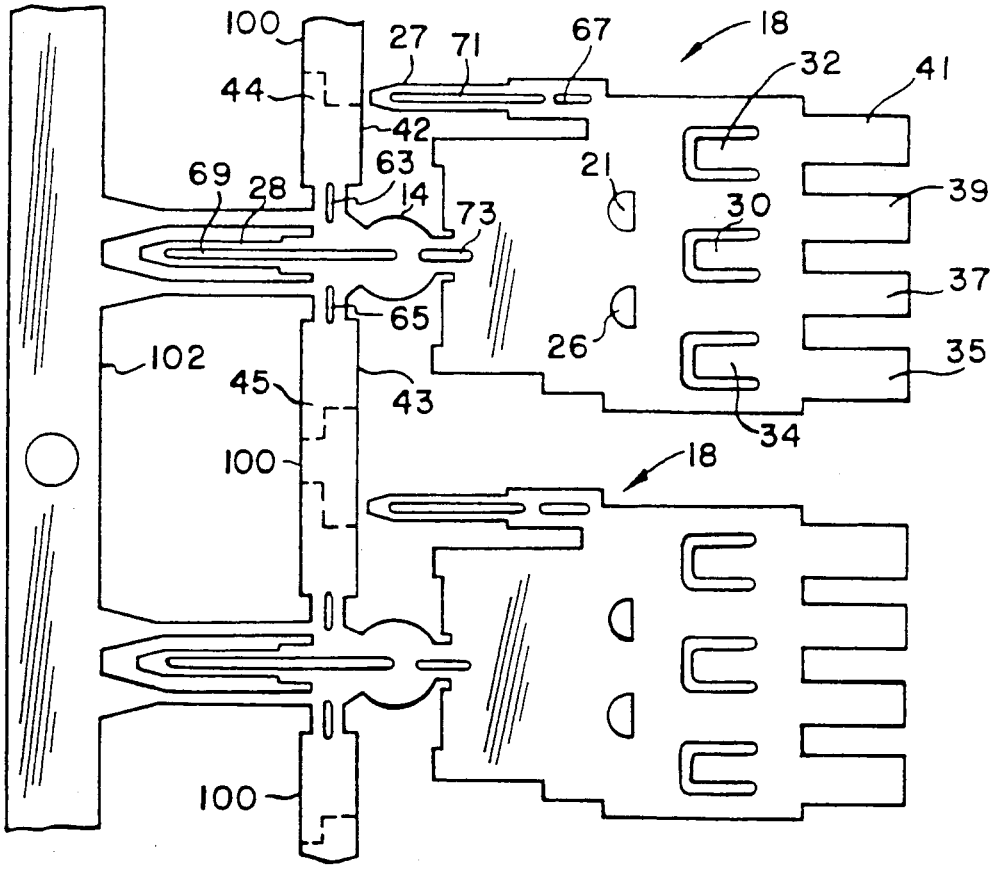
FIG. 28 is a plan view of one section of a blank stamped to form the outer shell of the receptacle connector of FIG. 1.

FIGS. 28-35 will now be fully explained to disclose a preferred assembly process for the receptacle connector 10. The outer shell 18 for each receptacle connector is stamped from a metal sheet as shown in FIG. 28. A multiplicity of blanks forming the initial shape of the outer shell can be attached to a center carrier 100 and a rear carrier 102 for easier handling during the production process. Initially, a blank is cut in a generally rectangular shape having projections for the contact fingers 35, 37, 39, and 41, and C-shaped cut-outs for the latches 30, 32, and 34. The cowl-shaped stops 26 and 21 are formed during this period by raised projections in the stamping die (not shown). The carriers 100, 102 are attached to the blanks at the tail portion of the outer shell, which has the circular end cover 14 attached to a T-shaped tail. The center carrier 100 will be used to form the side flaps 42, 43 and the end tabs 44, 45 of the outer shell, and the bottom of the tail will be used to form the rear terminal leg 28. Ribs 67, 71 of the front terminal leg 27 and rib 69 of the rear terminal leg 28, respectively, and ribs 63, 65, and 73 of the side flaps 42, 43 and tail portion 14, respectively, are formed at this time by raised projections in the stamping die.

Figure 29:
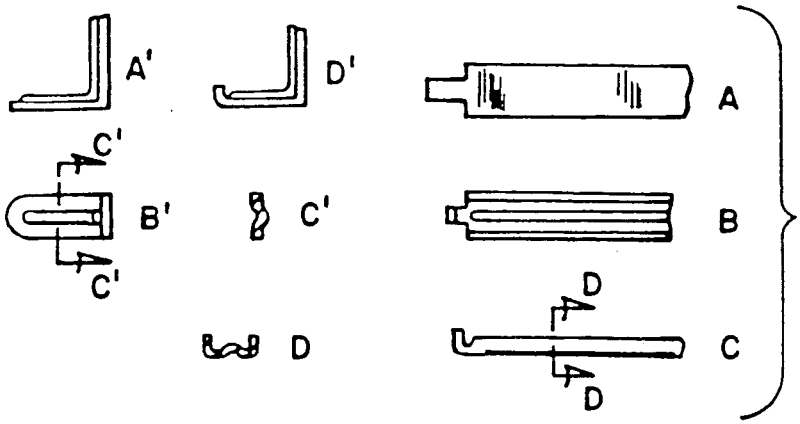
FIG. 29 is a fragmented portion of FIG. 28 illustrating several surface mounting terminal legs.

To this point, the terminal legs 27, 28 and conductor terminal 29 have been described as applicable to mounting in the through-holes of a printed circuit board 24. In FIG. 29 there are disclosed terminal legs and conductor terminals which are adapted for surface mounting on printed circuit boards. For surface mounted components, the printed circuit board will have component pads rather than through-holes. The center conductor and outside shell of the receptacle connector are preferably stamped and formed, which processes lend themselves readily to the formation of the most popular types of surface mounting terminal configurations. The typical shapes used in low voltage, UHF/VHF signal connectors are the gull-wing, the J-bend, and the L-wing. All of these shapes are easily made as shown in FIGS. 29A-D and 29A'-29D' by the stamping and forming operations.

Figure 35:
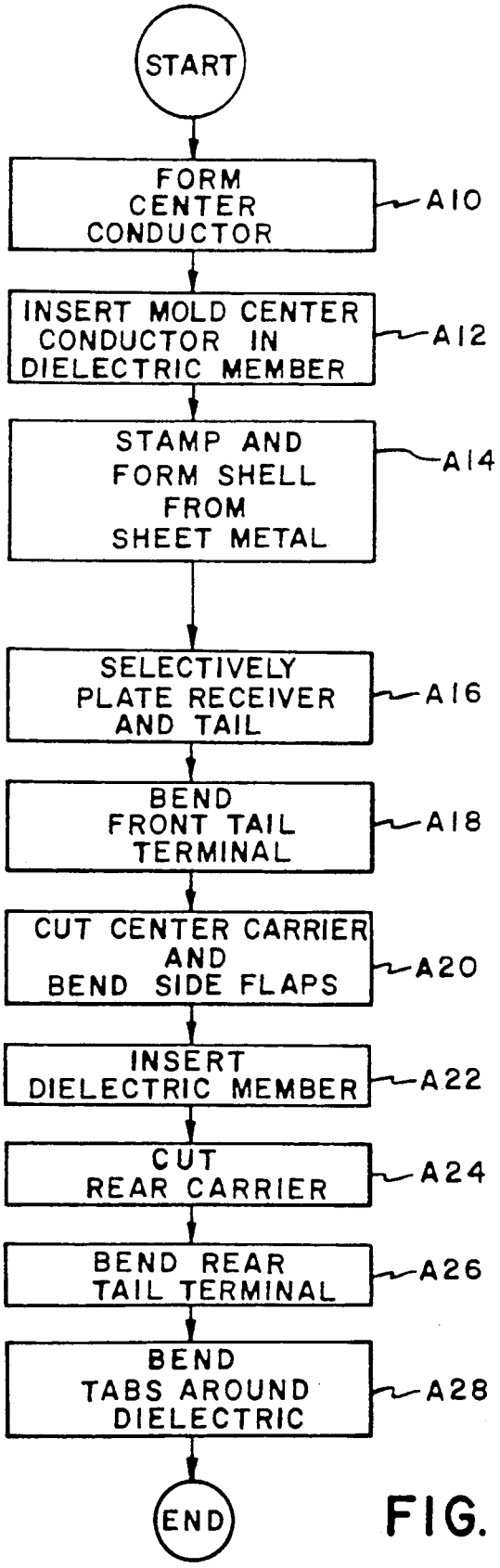
FIG. 35 is a process flowchart describing the various steps of assembly illustrated in FIGS. 30–34.

Referring now to FIG. 35, the process for assembling the receptacle connector 10 begins in block A10 by providing the center conductor 20. This is accomplished by either screw machining and bending the center conductor in a separate operation, or by stamping and forming the center conductor and then bending it 90° in a separate operation if a right angle connector is being made. Preferably, the center conductor 20 is stamped and formed on a carrier to have the desired proportions for the body, the terminal portion, and the front prong. In most cases, the step of barrel-plating or selectively plating (reel-to-reel) would be performed after step A10. Next in block A12, the center conductor 20 is insert molded into the dielectric member 33. The dielectric member 33 and insert-molded center conductor 20 subassembly is then set aside until a later step in the assembly process.

The outer shell 18 is then stamped and formed from a blank of sheet metal in block A14. The stamping and forming is accomplished in several steps. The final shape of the stamping is illustrated in FIG. 28. The outer shell is shown partially formed in FIG. 30 as a top view. After the receiver portion has been formed and while the receptacle connector 10 is still attached to the center carrier 100 and rear carrier 102, each end may selectively be plated (reel-to-reel). Preferably, during the plating process which occurs in block A16, the receiver means 11 is plated with a noble metal such as gold, silver, etc. to provide excellent conductivity to the contact fingers, and the terminal leg section is selectively plated or tinned to receive solder.

Figure 31:
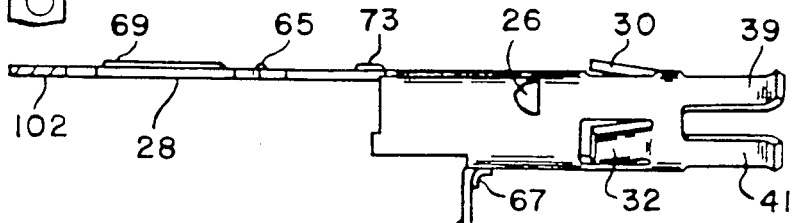
Figure 32:
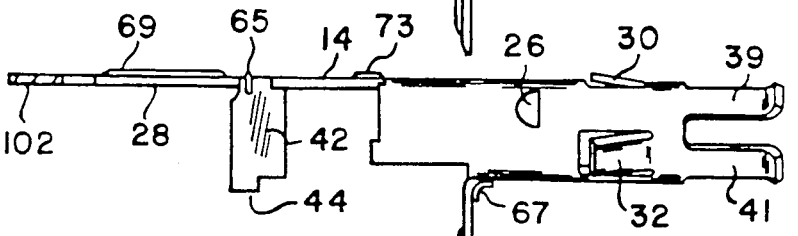
Figure 33:
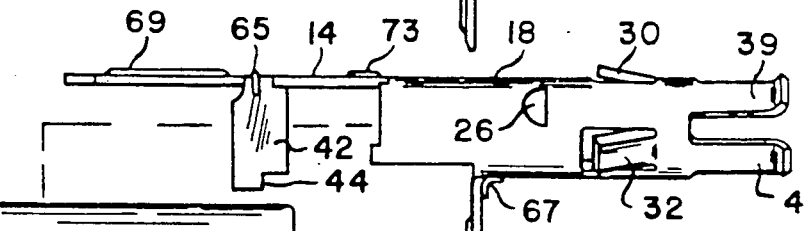
Figure 34:
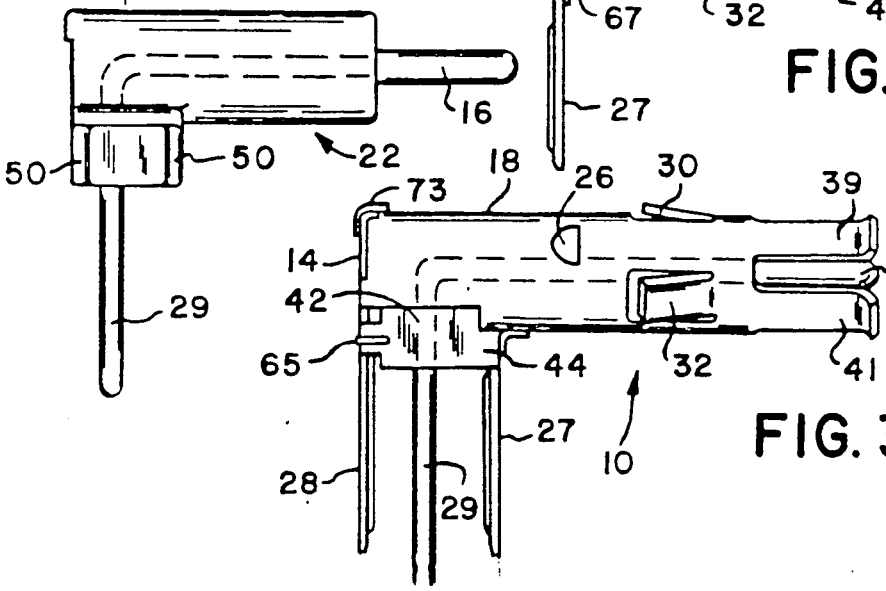

When the portions have been plated, the front terminal leg 27 is bent in block A18 which produces the outer shell shape illustrated in FIG. 31. Subsequently, the center carrier 100 is cut, and the side flaps 42, 43 are bent 90° in block A20 to form the shape illustrated in FIG. 32. The barrel of the receptacle connector 10 then receives the dielectric member and center conductor subassembly in block A22 from the rear as illustrated in FIG. 33. Once the dielectric member 33 and center conductor 20 have been inserted in the barrel, the rear carrier 102 is cut in block A24. The end cover 14 is bent down around the dielectric member 22 which positions the rear terminal leg 28 at 90° to the axis of the barrel in block A26. The final step in the assembly process is to bend the retaining tabs 44, 45 around the front of the base of the dielectric member 22 in block A28. The finished assembled receptacle connector is illustrated in FIG. 34.

Figure 38:
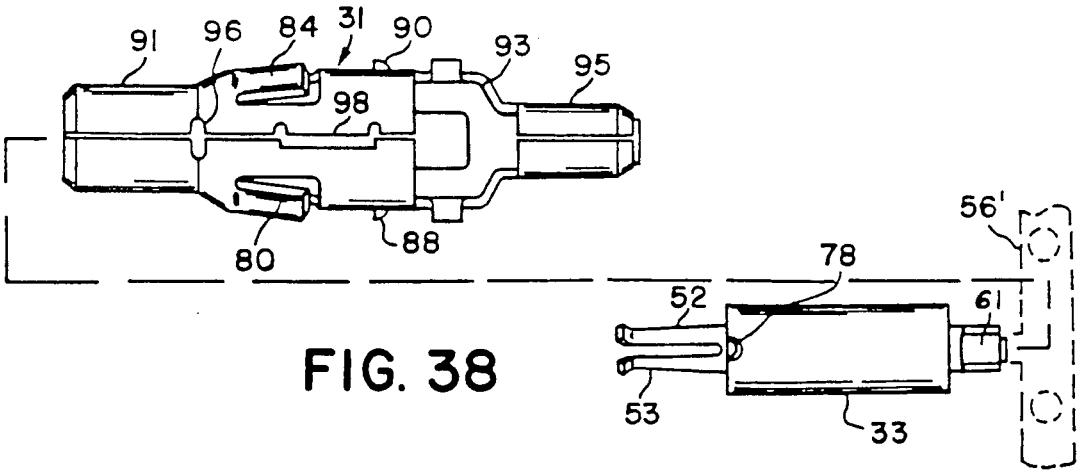
Figure 39:
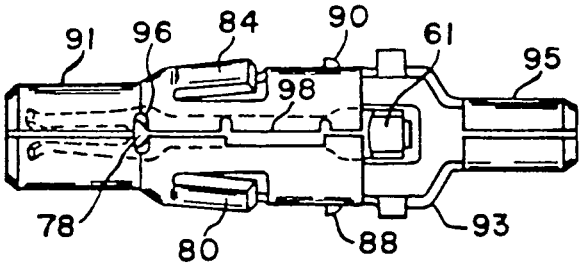
Figure 40:
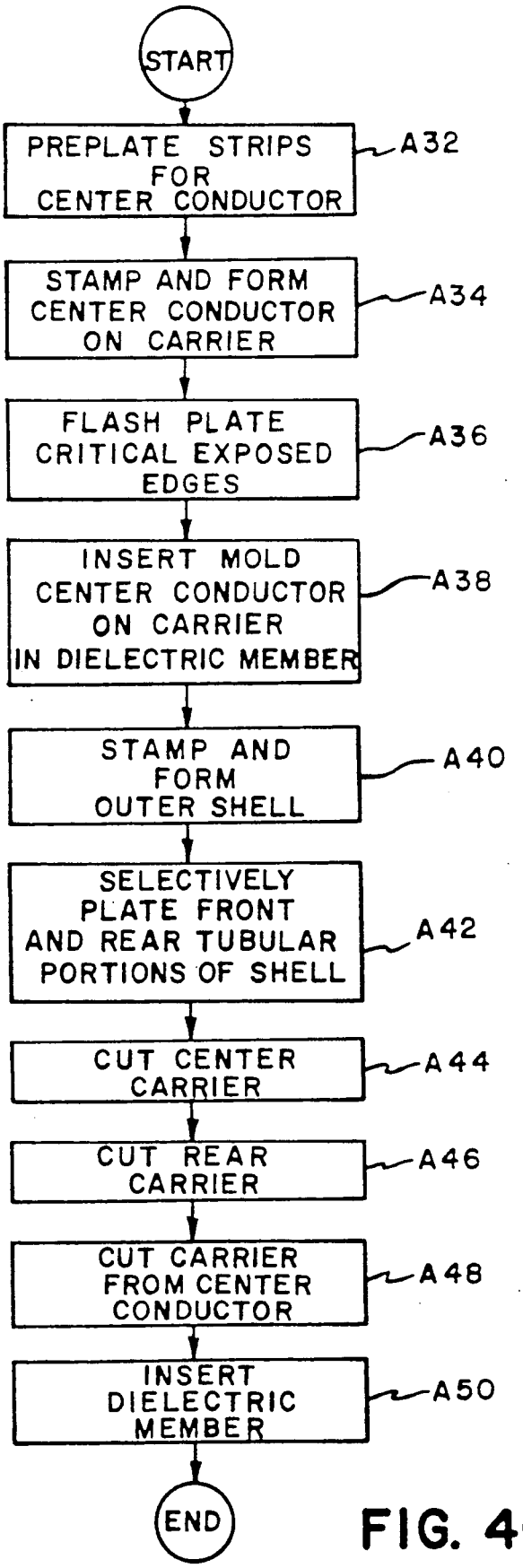
FIG. 40 is a process flowchart describing the various steps of assembly illustrated in FIGS. 37–39.

FIGS. 36–40 illustrate a process, which is similar to that described for the receptacle connector 10, for assembling the plug connector 12. FIG. 40 is a detailed process flowchart of the manufacturing/assembly process, and FIGS. 36–39 show various intermediate steps in the process. The outer shell 31 for each plug connector is stamped from a generally rectangular metallic blank as shown in a bottom view in FIG. 36. A multiplicity of blanks forming the initial shape of the outer shell can be attached to a center carrier 104 and a rear carrier 106 for easier handling during the production process. Initially, the blank is cut in the generally rectangular shape including portions for the front tube 91, the center body portion 93, and the rear tube 95. The center carrier 104 connects the adjacent center body cups 93 of the outer shells 31 with carrier material. The rear tube 95 of each outer shell 31 connects to the rear carrier 106 by a flashing. The spring latches 80, 82, and 84 and retaining tab 97 are formed in the blanks by C-shaped cutouts in the stamping die (not shown). The cowl-shaped stops 88 and 90 are also formed by raised projections on the stamping die, while the indents 92 and 94 are formed by raised projections on the opposite die face.

As illustrated in the flowchart of FIG. 40, the assembly process begins in block A32 by pre-plating a conductive stripe on the front and tail end of the center conductor strip (see FIG. 21). This provides tinning for the solder cup 61 at one end of the center conductor 56, and a conductive plating for the inner tines 52, 53 of the center conductor at the other end. Next, the center conductor 56 is formed in block A34 by shaping the stamped blank into the center conductor on a carrier 56', as illustrated in FIG. 21. The next step is to flash plate the exposed connector end in block A36. The finished center conductor 56 is inserted into a mold (not shown) for forming the dielectric member 33, and the molding process is accomplished in block A38. The center conductor 56 and dielectric member 33 subassembly may then be set aside while the outer shell 31 of the plug connector 12 is formed.

Figure 37:
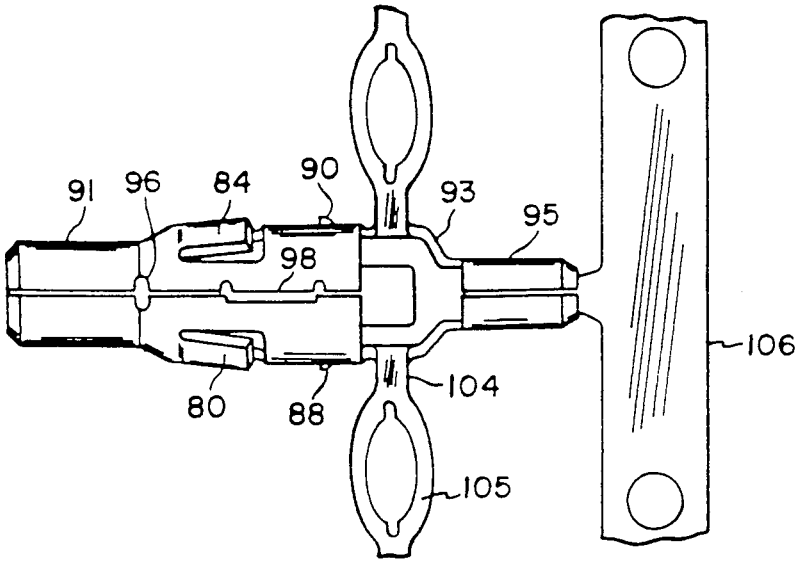
FIGS. 37–39 are pictorial representations of various stages of the assembly process for the plug connector illustrated in FIG. 1.

The outer shell 31 is initially stamped and formed from a blank in block A40 into the shape shown in FIG. 37. The blanks of each outer shell 31 are connected by a center carrier 104 and a rear carrier 106. These carriers are used in block A40 to help form the tubular shape of the shell 31. When the center cup 93 is formed, the circular portions 105 of the center carrier 104 deform (stretch) to allow the cup to take the shape illustrated in FIG. 37. The front and rear tubular sections 91, 95 of the outer shell 31 are then selectively plated in block A42, with gold for the front tube, and tinning composition for the rear tube. The center and rear carriers 104, 106 are then cut in blocks A44 and A46 to separate the individual outer shells 31. Thereafter, in block A48, the subassembly carrier 56' can be cut. In block A50, the dielectric member 33 is inserted into the outer shell 31 as illustrated in FIG. 38, being inserted from the front of the outer shell 31 as shown. The fully assembled plug connector 12 is illustrated in FIG. 39.

The manufacturing processes described for the receptacle connector 10 and the plug connector 12 are advantageous for several reasons. As explained earlier, the insert molding of the center conductors permits a convenient method of varying of impedance ratings of the connectors without changing the mold specifications or the stamping dies. The processes described herein lend themselves to forming precise diameters, and thus the impedance ratings may be varied not only over a wide range, but also within close tolerances so that very low VSWRs may be obtained with UHF and VHF coaxial cable connections. The ability to insert mold very small diameters for the center conductors enhances the ability to increase the impedance of these connectors to 75 ohms, or greater, without affecting the outside configuration of the shell.

The stamping, forming, and molding processes also allow a miniaturization of the connectors for a grid size of 0.050 in. $\times$0.050 in., or smaller, for a D-subminiature housing with sub-microminiature coaxial contacts. This miniaturization can be accomplished by scaling down sizes and thicknesses without significant changes in the design or assembling process. Thus, greater densities to the sub-microminiature level can be achieved while retaining the advantages of the low cost assembly and production processes. The sub-microminiature size can also be rated at 75 ohms or greater, to operate at the GHz level with precise impedance matching.

Additionally, because there are only two basic parts (the shell and dielectric member subassembly) to assemble, the assembly process is reduced in cost and can be highly automated. The stamping processes are well suited to automation because the carriers allow multiple pieces to be handled simultaneously and provide spacing and location information for the assembling machinery. All of these advantages permit a superior connector to be produced at a reduced manufacturing expense.

Figure 41:
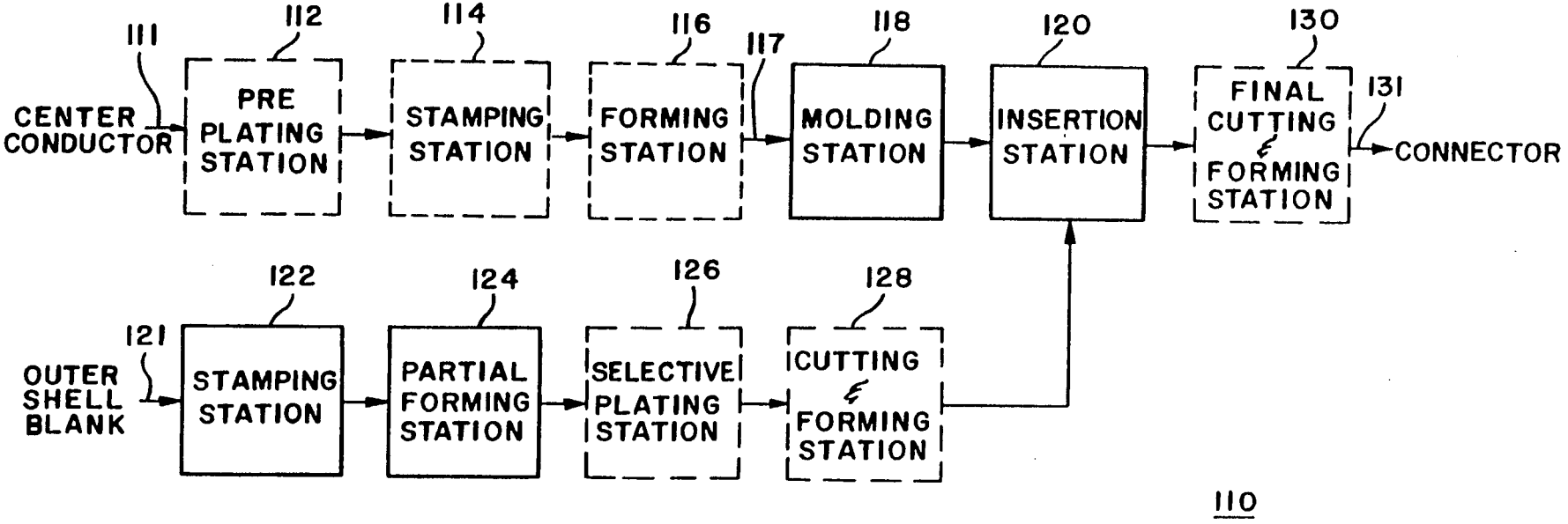
FIG. 41 is a system block diagram describing the various manufacturing stations used in the assembly process according to the invention.

Referring now to FIG. 41, a system 110 is illustrated for manufacturing and assembling the coaxial connectors in accordance with the invention. This manufacturing/assembly system can be adapted to build coaxial connectors having either the plug or receptacle configuration described above, as well as the various other types of angle and mounting configurations described below. The system 110 shown in FIG. 41 will be described in terms of a fully-automated assembly line. However, it will be seen that any individual station can be replaced by hand tooling or hand assembly. Furthermore, the articular blocks shown in dotted lines are optional manufacturing/assembly stations which may or may not be part of the system in a particular configuration.

Initially, either type center conductor 20 or 56 is provided to system 110 at 111. Depending upon the requirements of the particular application, the center conductor can be a screw-machined individual piece part, a stamped and formed individual piece part, or preferably a series of stamped center conductor blanks affixed to a carrier. The center conductors should have the desired dimensions for the middle body portion, the leg or terminal portion, and the front prong portion, as described above.

The center conductors are then fed, using a carrier, a vibratory feed mechanism, or by hand, to an optional pre-plating station 112. This station performs the process of selectively pre-plating a conductive stripe on the front prong and terminal leg portions of the center conductor. More specifically, this station provides tinning for the terminal portion 29 or the solder cup 61 of the various types of center conductors 20, 56, or provides conductive plating for the tines 52, 53 of the center conductor 56, or for the prong end 16 of center conductor 20. As mentioned above, the pre-plating station 112 can be omitted from the system 110, depending upon the particular requirements of the connector being manufactured.

In the preferred embodiment, stamping station 114 and forming station 116 stamps and forms a series of center conductor blanks affixed to a carrier. Again, either type of center conductor 20 or 56 can be stamped and formed in much the same way as previously shown for stamping and forming the outer shells. Reel-to-reel stamping with a straight-sided punch press machine with feed system available from Bruderer could be used at this station.

Forming station 116 either shapes the stamped blank into the center conductor on a carrier 56' as illustrated in FIG. 22, and/or bends the middle portion of the center conductor to have a right-angle configuration as shown in FIG. 9. The stamping and forming steps of a carrier blank are typically performed in one operation or at one station. Screw-machined center conductors could be formed to have a right angle or other angle in a separate operation within station 116, depending upon the desired connector configuration. For example, center conductor 56 of FIG. 21, which has a straight configuration, would only be stamped and formed from the blank into its final configuration without being formed with a right angle. Any right angle contact is bent is a separate operation after screw machining or stamping and forming since a right angle part cannot be conveniently reeled on a carrier when stamped and formed or bent in the screw machining operation.

In certain applications, it may be desired to flash-plate certain exposed edges of the connector end, such as described in block A36 of FIG. 40. Flash plating the center conductor provides a barrier for atmospheric corrosion of exposed edges, which occurs during the stamping operation on preplated metal. This step would be accomplished with an optional flash plating system (not shown) at 117 of system 110, before the molding step is undertaken.

The finished center conductor, 20 or 56, is then inserted in to a mold at molding station 118 to add the dielectric member. Apparatus for insert molding devices are well-known in the art, such as hand-fed (loose piece or comb) or reel-fed on a carrier, available from Techmire Ltd., Toronto, Canada. As described above, the dielectric member is molded from a suitable insulative and dielectric material, typically Teflon or some other polyfluoro plastic. The molding station 118 shapes the dielectric member into a predetermined external form around the middle body portion of the center conductor, such that its outer ends are exposed for electrical connection.

As previously mentioned, insert molding the center conductor into the dielectric member allows a single system to manufacture coaxial connectors having different characteristic impedances, by providing different center conductors having only their middle body portions being of a different outer cross-sectional dimension, without changing the other elements of the system. For example, FIGS. 9 and 10 show different right-angle center conductors for receptacle connectors having different impedances, which would be manufactured in system 110 without any changes to the molds in molding station 118 or any subsequent stations.

Figure 30:
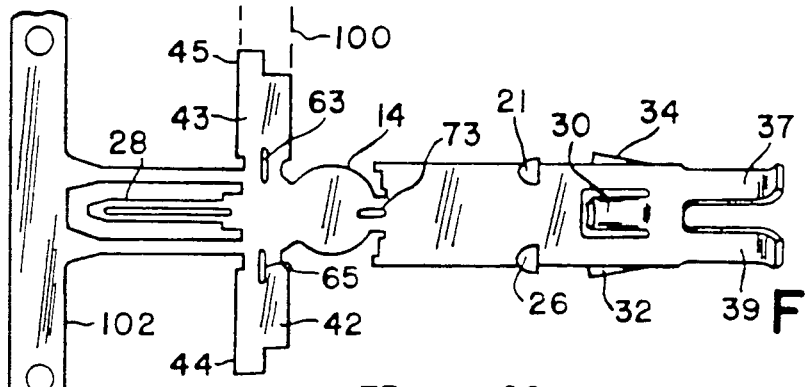
FIGS. 30–34 are pictorial representations of various stages of the assembly process for the receptacle connector illustrated in FIG. 1.
Figure 36:
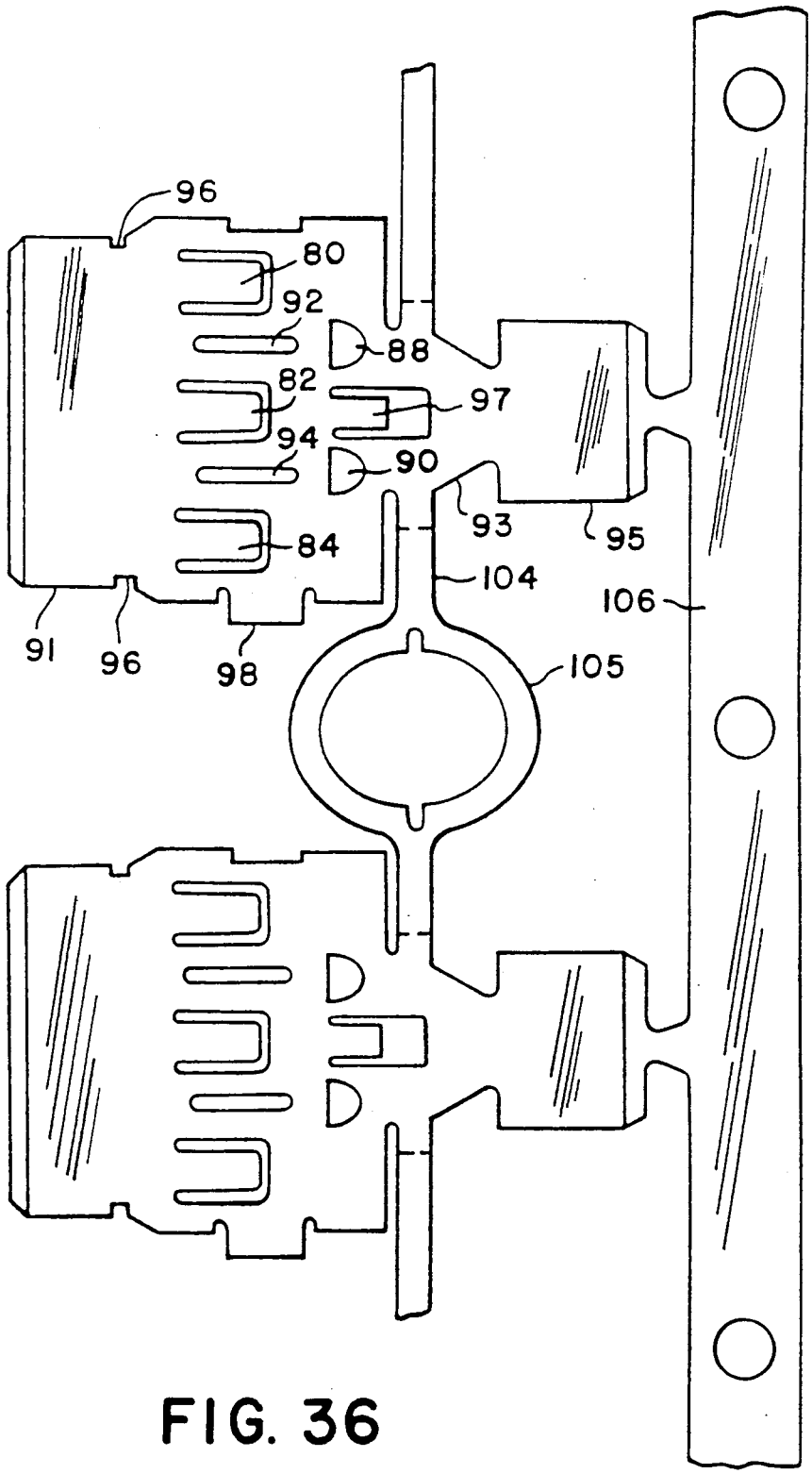
FIG. 36 is a plan view of one section of a blank stamped to form the outer shell of the plug connector of FIG. 1.

An outer shell blank, provided at 121, is stamped and formed in stamping station 122 and partial forming station 124. The blank is stamped into the shape of either a receptacle connector as shown in FIG. 28, having center carrier 100 and rear carrier 102, or into a plug connector blank as shown in FIG. 36, having center carrier 104 and rear carrier 106. Partial forming station 124 forms the front portion of the blank to have a substantially tubular shape as shown in FIGS. 30 and 37. Other detailed features of the outer shell may also be formed at this station as required.

Selective plating station 126 plates portions of the outer shell, as described in steps A16 and A42 of the above flowcharts. This selective plating station is optional, and its use would depend upon the particular specifications for the outer shell and the overall configuration of the other stations of system 110.

Cutting and forming station 128, also optional, performs the function of partially forming other parts of the outer shell, and/or cutting the outer shell from the carrier, as described in flowchart steps A18–A22 and A44–A48 above. Again, the particular cutting and forming operations of this station would be determined by other system parameters. For example, if the insertion of the dielectric member/center conductor subassembly into the formed outer shell is to be performed manually, then cutting and forming station 128 would remove the completely-formed parts from their respective carriers. On the other hand, if the manufacturing-/assembly system 110 is completely automated, then, depending upon how the stamped and formed connectors are attached to their respective carriers, the carriers would not have to be removed until a final cutting and forming station.

The dielectric member/center conductor subassembly is inserted into the formed outer shell in insertion station 120. This insertion could be performed by hand in a manual assembly line, or could be semi-automated using a vibratory feed bowl for the loose piece parts, or could be reel-fed via the carriers to a fully-automated insertion station. Automated insertion machines are well known in the art. Alternatively, the operation of the insertion station 120 could be combined with a forming operation to form the outer shells around the inner dielectric subassembly.

Final cutting and forming station 130 finishes the connector manufacturing and assembling operation, and provides the completed connector in piece-part form at 131. The final cutting and forming operation is particularly necessary for right-angle receptacle connectors formed on a carrier. As described in steps A24–A28 of the flowchart of FIG. 35, the tail portion 14 of the right-angle receptacle is bent down around the base portion of the dielectric member 22 as shown in FIG. 34. The retaining tabs 44, 45 are also bent around the front of the base portion. In a fully automated system, the completely-assembled coaxial connector would be cut from its carrier in station 130. Of course, different final cutting and forming operations would be performed for the different types of coaxial connectors. Machines for performing the cutting and forming operations are well known in the art.

As can now be more fully appreciated, a system for manufacturing a coaxial connector, having a desired characteristic impedance Z, has been disclosed in detail. The system includes: a station for stamping and forming an outer shell for the coaxial connector, where the outer shell has at least a portion having a substantially tubular shape with a predetermined inner cross-sectional dimension X; a station for providing a center conductor having an elongated shape and a tip portion at a first end, a middle body portion, and a leg portion at a second end, wherein the tip portion has a predetermined shape, and wherein the middle body portion has an outer cross-sectional dimension Y; a station for molding a dielectric member of a predetermined form around at least the middle body portion of the center conductor, thereby providing an inner subassembly; and a station for inserting the inner subassembly into the tubular-shaped portion of the outer shell, thereby providing the coaxial connector.

Depending upon the sophistication of the apparatus used to implement the system, the center conductor and/or the outer shell can be stamped and formed from a blank of sheet metal and carried throughout the assembly process on the sheet metal carrier. Furthermore, depending upon the particular type of connector desired additional cutting and forming operations or selective plating operations may be required. Nevertheless, once the system is set up to run a particular type of coaxial connector, none of the stations have to be changed to produce connectors having a different impedance, except for the station which provides the center conductor itself. For example, both 50 ohm and 75 ohm right-angle printed circuit mount coaxial receptacle connectors can be manufactured and assembled on the same system by simply altering the outer cross-sectional dimension Y of the middle body portion of the center conductor as a function of the desired predetermined characteristic impedance of the connector.

Figure 42A:
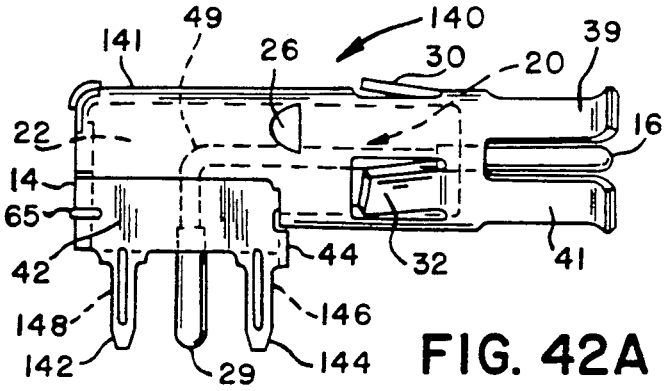
FIG. 42A is a side view of a five-leg right-angle printed circuit mount coaxial receptacle connector according to another embodiment of the invention.
Figure 42B:
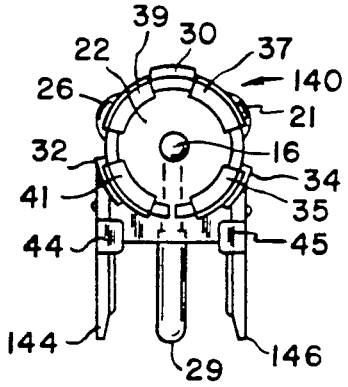
FIG. 42B is a front view of the receptacle connector of FIG. 42A.
Figure 42C:
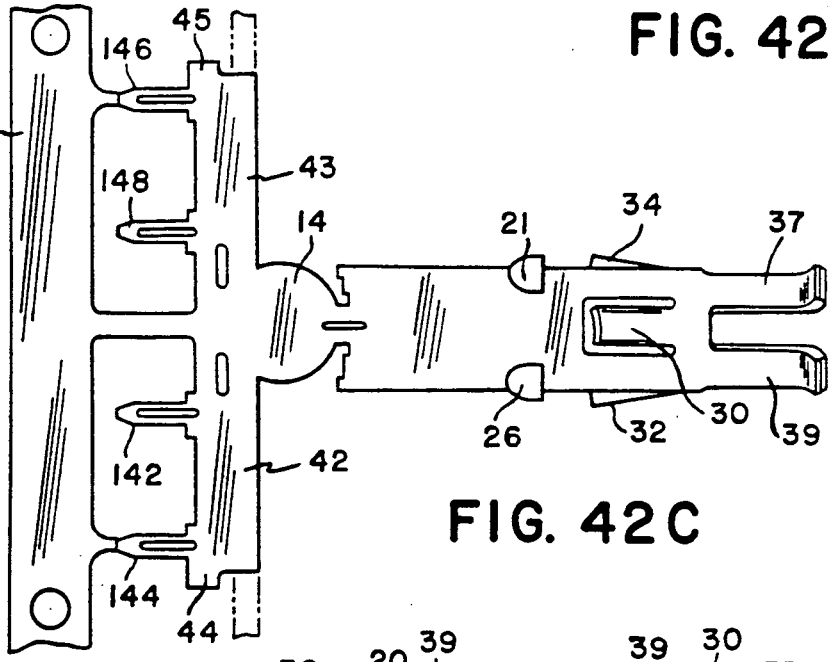
FIG. 42C is a plan view of one section of a blank carrier which has been partially stamped and formed to provide the outer shell of the receptacle connector of FIG. 42A.

With reference to FIG. 42A, a side view of a five-leg right-angle printed circuit mount coaxial receptacle connector 140 is shown in accordance with another embodiment of the present invention. The five-leg connector 140 is very similar to the three-leg connector 10 illustrated in FIG. 5. The front view of connector 140 shown in FIG. 42B, and the plan view of the stamped and partially formed blank shown in FIG. 42C, generally correspond to FIGS. 8 and 30, respectively, of the three-leg connector. However, in the five-leg embodiment, the tail portion 14 of the outer shell 141 has been modified to include four terminal legs 142, 144, 146, and 148. The length and style of the terminal legs would vary, depending upon the desired application. Both through-hole and surface mount styles can readily be accommodated.

Figure 43A:
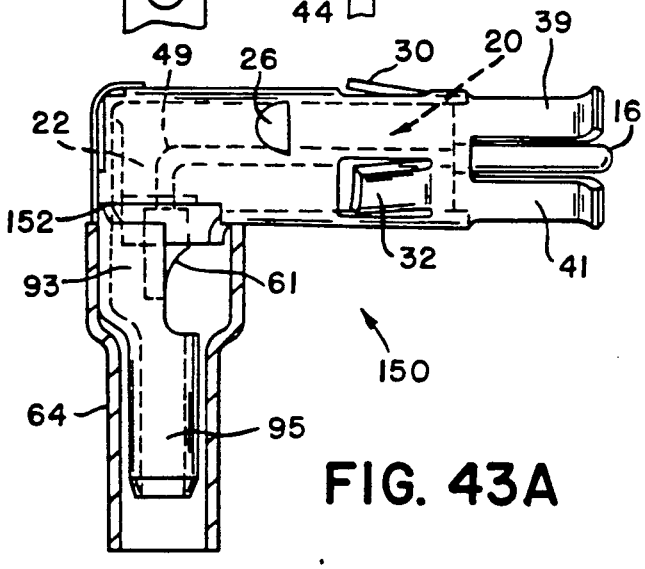
FIG. 43A is a side view of a right-angle coaxial receptacle connector adapted for coaxial cable termination.
Figure 43B:
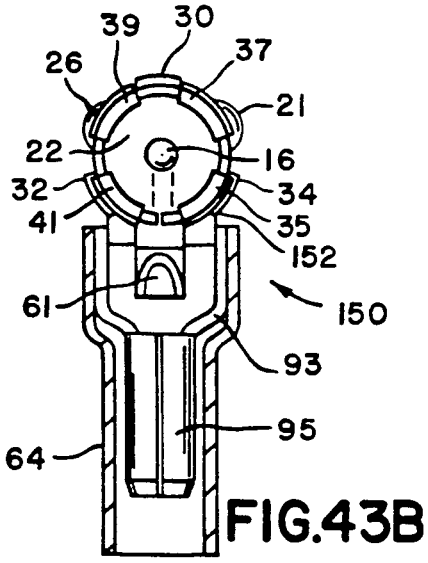
FIG. 43B is a front view of the receptacle connector of FIG. 43A.

FIGS. 43A and 43B show side and front views, respectively, of a right-angle coaxial receptacle connector 150 which is adapted for coaxial cable termination, as opposed to printed circuit board mounting. The cable termination portion of connector 150 corresponds to that of the straight coaxial plug connector illustrated in FIGS. 16–19, with the exception that the outer shell 152 has been modified to exhibit the right-angle configuration. The solder cup 61 and the ferrule 64 of the center conductor 20 perform the same functions of coupling the braided shield and center conductor of the coaxial cable to the coaxial connector.

Figure 44A:
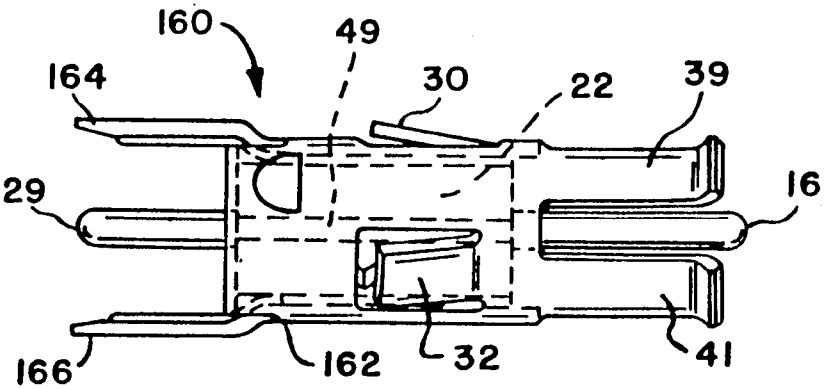
FIG. 44A is a side view of a three-leg straight printed circuit board mount coaxial receptacle connector in accordance with another embodiment of the invention.
Figure 44C:
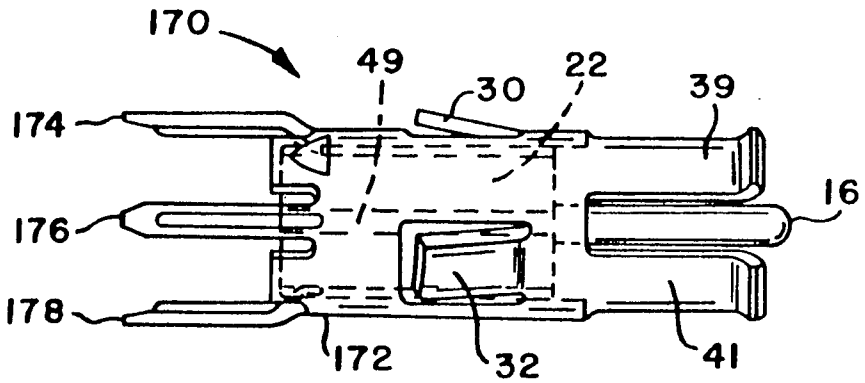
FIG. 44C is a five-leg embodiment of the coaxial receptacle connector of FIG. 44A.
Figure 44B:
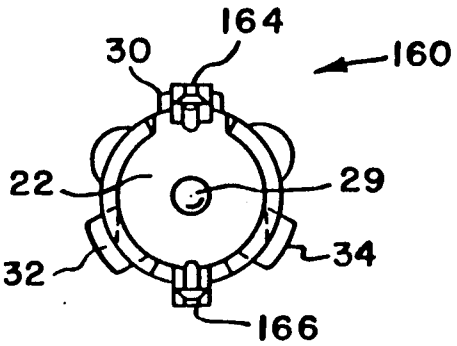
FIG. 44B is a rear view of the receptacle connector of FIG. 44A.

FIGS. 44A and 44B illustrate a further embodiment of the present invention, wherein a side and rear view, respectively, of a three-leg straight printed circuit board mount coaxial receptacle connector 160 is shown. The three legs include the end of the center conductor 29, and the first and second terminal legs 164, 166 formed from the outer shell 162. Straight receptacle connector 160 corresponds in all other respects to right-angle receptacle connector 10 of FIGS. 4–8.

Figure 44D:
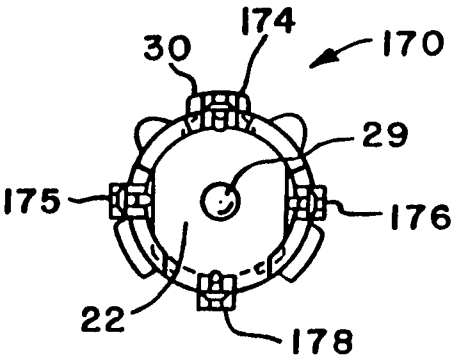
FIG. 44D is a rear view of the receptacle connector of FIG. 44C.

FIGS. 44C and 44D illustrate a five-leg embodiment of the coaxial receptacle connector of FIG. 44A, again shown in side and rear views, respectively. The five-leg embodiment 170 has an outer shell 172 which has been stamped and formed to provide four printed circuit mount terminal legs 174, 175, 176, and 178.

Figure 45A:
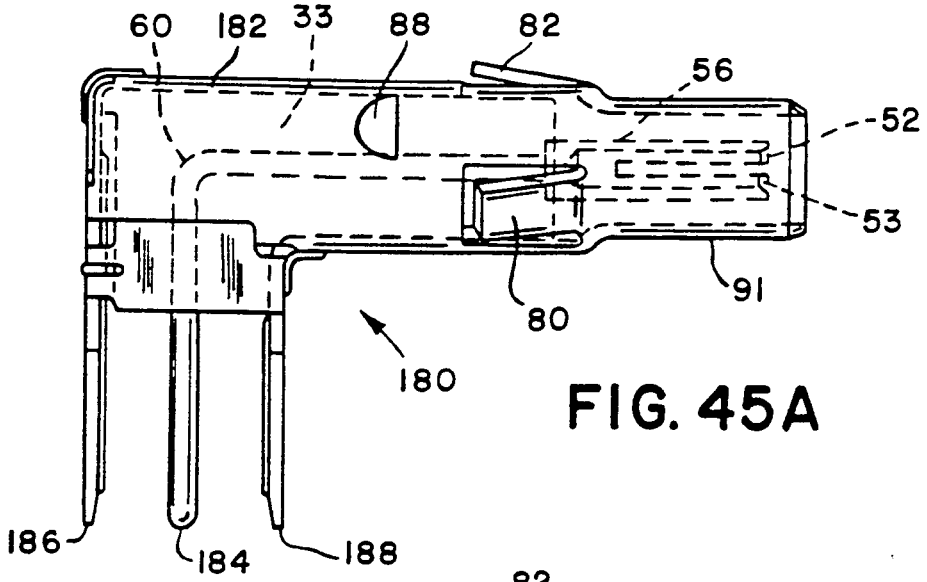
FIG. 45A is a side view of three-leg right-angle printed circuit board mount coaxial plug connector in accordance with another embodiment of the invention.

FIG. 45A is a side view of a three-leg right-angle printed circuit board mount coaxial plug connector embodiment. Plug connector 180 is very similar to plug connector 12 of FIGS. 16–19, with two primary modifications. First, the outer shell 182 and the center conductor 60 have been formed to exhibit the right-angle configuration for purposes of mounting the connector parallel to the printed circuit board. Second, the outer shell has been stamped and formed to include two printed circuit board mount terminal legs 186 and 188, instead of being adapted for coaxial cable termination.

Figure 45B:
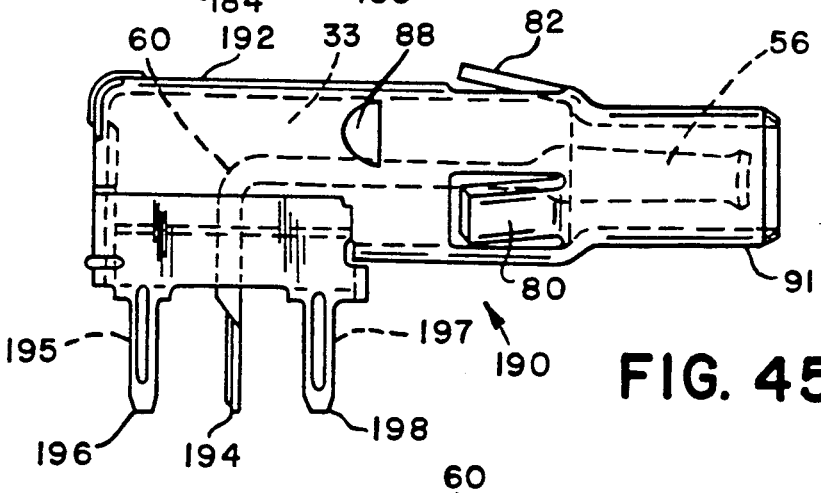
FIG. 45B is a side view of a five-leg embodiment of the right-angle printed circuit board mount coaxial plug connector of FIG. 45A.

FIG. 45B is a side view of a five-leg embodiment 190 of the right-angle printed circuit board mount coaxial plug connector of FIG. 45A. Several minor modifications should be noted. First, the outer shell 192 has been stamped and formed to provide four printed circuit board mounting legs 195, 196, 197, and 198. Second, the center conductor 60 has been stamped and formed to provide the fifth terminal leg 194, which exhibits a flat terminal portion at the end, having a lengthwise rib. Third, all five legs have been shortened with respect to those of FIG. 45A.

Figure 45C:
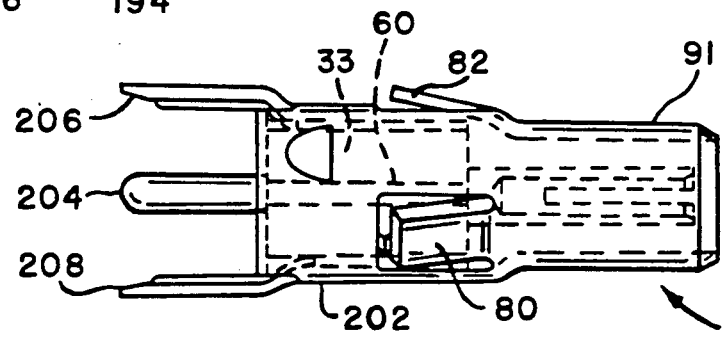
FIG. 45C is a side view of a three-leg straight printed circuit board mount coaxial plug connector in accordance with still another embodiment of the invention.
Figure 45D:
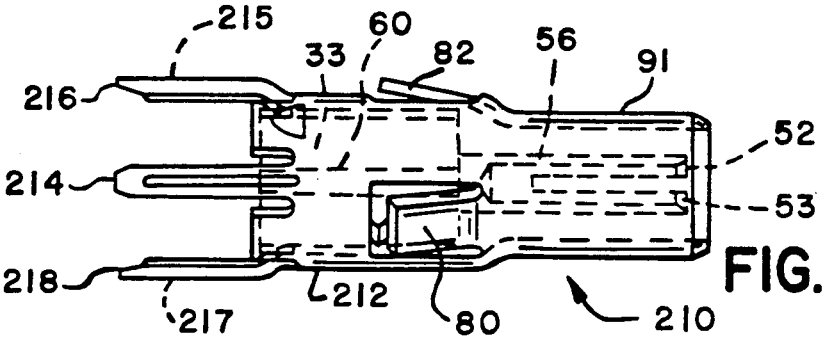
FIG. 45D is a side view of a five-leg embodiment of the coaxial plug connector of FIG. 45C.

FIGS. 45C and 45D illustrate three-leg and five-leg embodiments, respectively, of a straight printed circuit board mount coaxial plug connector. In the three-leg embodiment 200, the outer shell 202 has been stamped and formed to provide terminal legs 206 and 208, and the center conductor 60 provides the third terminal leg 204. In the five-leg embodiment 210, the outer shell 212 provides legs 215, 216, 217, and 218, while the center conductor 60 provides a flat, ribbed, stamped and formed terminal leg 214.

Figure 46A:
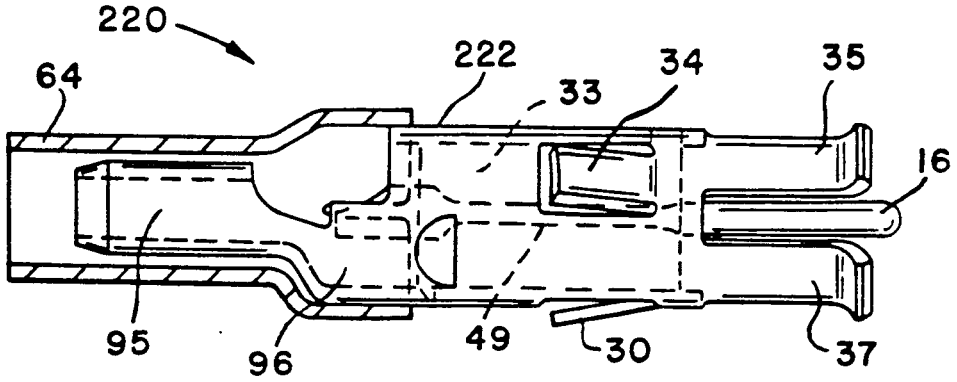
FIG. 46A is a side view of another embodiment showing a straight coaxial receptacle connector adapted for cable termination.
Figure 46B:
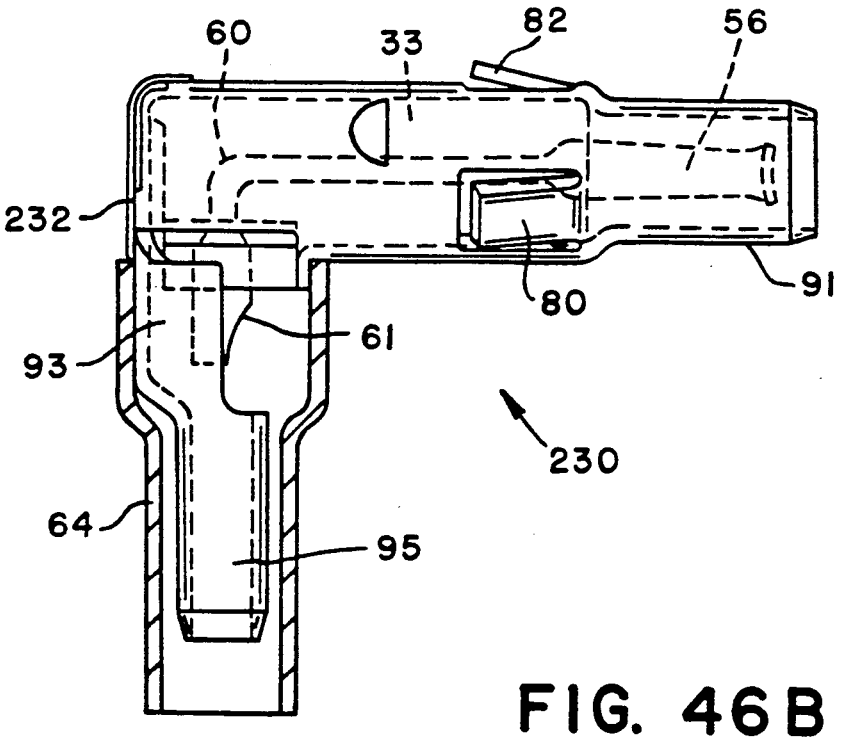
FIG. 46B is a side view of still another embodiment of the invention showing a right-angle coaxial plug connector adapted for cable termination.

Finally, FIGS. 46A and 46B show further embodiments of coaxial connectors adapted for cable termination. In FIG. 46A, a straight coaxial receptacle connector 220 is shown, wherein the rear portion of the outer shell 222 exhibits the straight-through cable termination configuration of the plug connector 12 shown in FIGS. 16–19, while the front portion of the outer shell 222 exhibits the four spring finger contact configuration of the receptacle connector 10 shown in FIGS. 4–8. FIG. 46B shows a side view of a right-angle coaxial plug connector 230 also adapted for cable termination. Again, the outer shell 232 and the center conductor 60 have been formed into the right-angle connector configuration.

In review, it can now be seen that all of the various connector configurations, whether straight or right-angle, plug or receptacle, printed circuit board mount or coaxial cable termination, three-leg or five-leg, or through-hole or surface mount, can be manufactured and assembled using the insert molding manufacturing and assembling process illustrated in system 110. Moreover, the characteristic impedance of each of the types of connectors can be predetermined, and the outer cross-sectional dimension of the middle body portion of the center connector be selected as a function of this desired impedance. Since the characteristic impedance of the coaxial connector is a function of the ratio of the inner diameter of the outer shell to the outer diameter of the center conductor, only the latter needs to be varied to produce difference impedance connectors. Depending upon the particular configuration of the system, either a center conductor having a different cross-sectional dimension for the middle body portion may be provided to the system, or the system itself would be slightly modified to stamp and form center conductors having the different cross-sectional dimension. In either case, the remaining elements of the system do not have to be modified to produce connectors of different impedances.

While specific embodiments of the present invention have been shown and described herein, further modifications and improvements may be made by those skilled in the art. For example, the cross-sectional shape of either the center conductor or the outer shell need not be circular, since the characteristic impedance of the connector is determined as a function of the relationship of these dimensions. In other words, the outer shell may have a tubular configuration exhibiting a square cross-section, and/or the center conductor may exhibit a flat yet elongated shape, wherein a particular cross-sectional dimension X or Y of these parts is substantially uniform over the length of the middle body portion. Moreover, the particular connector embodiments disclosed above could really be modified to fit various other coaxial cable applications. All such modifications which retain basic underlying principles disclosed and claimed herein are within the scope of this invention.

What is claimed is:

1. A system for manufacturing a coaxial connector having a characteristic impedance Z, said system comprising:

means for stamping and at least partially forming an outer shell for said coaxial connector, said outer shell having at least a portion having a substantially tubular shape with a predetermined inner cross-sectional dimension X;

means for providing a center conductor having an elongated shape and a tip portion at a first end, a middle body portion, and a leg portion at a second end, said tip portion having a predetermined shape, said middle body portion having an outer cross-sectional dimension Y;

means for molding a dielectric member of a predetermined form around at least said middle body portion of said center conductor, thereby providing an inner subassembly; and means for inserting said inner subassembly into said tubular-shaped portion of said outer shell, thereby providing said coaxial connector.

2. The system according to claim 1, further comprising means for plating at least portions of said center conductor before said center conductor is molded.

3. The system according to claim 1, further comprising means for plating at least portions of said outer shell before said inner subassembly is inserted into said outer shell.

4. The system according to claim 1, further comprising means for forming a portion of said outer shell after said inner subassembly has been inserted in said outer shell.

5. The system according to claim 1, wherein any particular cross-sectional outer dimension Y of said middle body portion of said center conductor is substantially constant throughout its length, and wherein said dielectric member is molded around the entire length of said middle body portion of said center conductor.

6. The system according to claim 1, wherein the cross-sectional outer dimension Y of said middle body portion of said center conductor is substantially less than that of said tip portion.

7. The system according to claim 1, wherein said means for providing a center conductor includes means for stamping and forming said center conductor from sheet metal.

8. The system according to claim 1, wherein said means for providing a center conductor includes means for providing a center conductor on a carrier.

9. The system according to claim 1, wherein said means for stamping and forming an outer shell includes means for forming said outer shell on a carrier.

10. The system according to claim 1, wherein said system is adapted to manufacture coaxial connectors having different characteristic impedances by providing different center conductors having only their middle body portions being of a different outer cross-sectional dimension, without changing the other elements of the system.

11. The system according to claim 1, further comprising means for forming a bend in said middle body portion of said center conductor before said center conductor is molded.

12. The system according to claim 11, wherein said bend in said middle body portion of said center conductor is substantially a right angle.

13. The system according to claim 1, wherein said outer cross-sectional dimension Y of said middle body portion of said center conductor is determined as a function of a desired predetermined characteristic impedance of the connector.

14. The system according to claim 13, wherein said characteristic impedance of the connector is approximately given by:

$$Z = \frac{C}{\sqrt{E_c}} \log \frac{X}{Y}$$

wherein

Z = the desired characteristic impedance of the coaxial connector,

C = a predetermined constant, $E_c$ = the combined dielectric constant of said dielectric member and air within the outer shell, X = the inner cross-sectional dimension of said tubular-shaped portion of said outer shell, and Y = the outer cross-sectional dimension of said middle body portion of said center conductor.

15. The system according to claim 14, wherein said tubular-shaped portion of said outer shell has a substantially uniform cylindrical shape such that said inner cross-sectional dimension X represents its inner diameter.

16. The system according to claim 14, wherein said middle body portion of said center conductor has a substantially uniform cylindrical shape such that said outer cross-sectional dimension Y represents its outer diameter.

17. The system according to claim 1, further comprising means for cutting and forming a bendable tail portion attached to said outer shell, said tail portion having a bendable flap extending from each side which ends in a bendable tab.

18. The system according to claim 17, further comprising means for forming a plurality of terminal legs in said bendable tail portion of said outer shell, said terminal legs being adapted for mounting said coaxial connector a printed circuit board.

19. The system according to claim 17, further comprising means for forming stiffening ribs in at least some of the bendable portions of said outer shell.

20. The system according to claim 19, wherein said stiffening ribs are constructed and arranged to be perpendicular to the axis of the bend and extend over the bend.

21. A coaxial connector having a desired characteristic impedance Z, said coaxial connector comprising:

an inner subassembly including a center conductor having at least one major longitudinal axis, two ends, and a middle body portion, said middle body portion having a substantially uniform outer cross-sectional dimension Y taken perpendicular to said major longitudinal axis, said outer cross-sectional dimension Y being selected as a function of the desired characteristic impedance Z of said coaxial connector, said middle body portion being molded within a dielectric member such that said two ends are accessible for electrical connection, said dielectric member having a predetermined external form; and an outer shell being stamped and formed from a metallic sheet to have at least a portion having a mating shape with said predetermined external form of said dielectric member, said outer shell disposed over said dielectric member and substantially around said major longitudinal axis of said center conductor but not electrically connected to said center conductor, said mating portion of outer shell having a predetermined inner cross-sectional dimension X taken perpendicular to said major longitudinal axis, whereby the characteristic impedance Z of said coaxial connector can be altered by selecting a different outer cross-sectional dimension Y for said middle body portion of said center conductor without altering said predetermined external form of said molded dielectric member.

22. The coaxial connector according to claim 21, wherein said coaxial connector includes a plug end adapted for insertion into the receiver of a receptacle end connector, and wherein said center conductor includes a fork-shaped receiver being dimensioned to receive a standard-sized prong of the receptacle connector.

23. The coaxial connector according to claim 21, wherein said coaxial connector includes a receptacle and adapted for receiving a plug end connector, and wherein said center conductor includes a prong end dimensioned to be received by a standard-sized fork-shaped receiver of the plug connector.

24. The coaxial connector according to claim 21, wherein said center conductor is stamped and formed from a sheet metal blank.

25. The coaxial connector according to claim 21, wherein the characteristic impedance Z of the connector is greater than 50 ohms.

26. The coaxial connector according to claim 21, wherein said inner diameter of said outer shell and said outer diameter of said center conductor are formed within such a tolerance, that the resulting connector exhibits an impedance variation of ±0.5 ohms.

27. The coaxial connector according to claim 21, wherein said characteristic impedance of the connector is approximately given by:

$$Z = \frac{C}{\sqrt{E_c}} \log \frac{X}{Y}$$

where

Z = the desired characteristic impedance of the coaxial connector,

C = a predetermined constant, $E_c$ = the combined dielectric constant of said dielectric member and air within the outer shell, X = the inner cross-sectional dimension of said tubular-shaped portion of said outer shell, and Y = the outer cross-sectional dimension of said middle body portion of said center conductor.

28. The coaxial connector according to claim 21, wherein said middle body portion of said center conductor includes a bend which was introduced before said center conductor is molded.

29. The coaxial connector according to claim 28, wherein said bend in said middle body portion of said center conductor is substantially a right angle.

30. The coaxial connector according to claim 28, wherein said dielectric is molded around said bent portion of said center conductor.

31. The coaxial connector according to claim 21, wherein a first of said two ends of said center conductor has a substantially uniform outer cross-sectional dimension $Y_1$, which is substantially different than said outer cross-sectional dimension Y.

32. The coaxial connector according to claim 37, wherein the outer cross-sectional dimension Y of said middle body portion of said center conductor is substantially smaller than the outer cross-sectional dimensions $Y_1$ of said first end of said center conductor, thereby aiding the retention of said center conductor within said molded dielectric member.

33. The coaxial connector according to claim 21, wherein said middle body portion of said center conductor has a substantially uniform cylindrical shape such that said outer cross-sectional dimension Y represents its outer diameter.

34. The coaxial connector according to claim 33, wherein the ratio of diameter X to dimension Y is approximately 3.3 when the characteristic impedance Z is approximately 50 ohms.

35. The coaxial connector according to claim 33, wherein the ratio of diameter X to dimension Y is approximately 4.2 when the characteristic impedance Z is approximately 60 ohms.

36. The coaxial connector according to claim 33, wherein the ratio of diameter X to dimension Y is approximately 6.0 when the characteristic impedance Z is approximately 75 ohms.

37. The coaxial connector according to claim 21, wherein the portion of said outer shell which has a mating shape with said predetermined external form of said dielectric member has a circular cross-section, such that said inner cross-sectional dimension X represents the inner diameter.

38. The coaxial connector according to claim 37, wherein the outer diameter of said outer shell is approximately 0.187 inches.

39. The coaxial connector according to claim 21, wherein said outer shell includes a tail portion having a plurality of integrally-formed terminal legs adapted for mounting on a printed circuit board.

40. The coaxial connector according to claim 39, wherein said terminal legs are adapted for surface mounting on a printed circuit board.

41. The coaxial connector according to claim 39, wherein said tail portion of said outer shell includes four terminal legs.

42. The coaxial connector according to claim 39, wherein said tail portion includes portions having substantial bends and having stiffening ribs which are constructed and arranged to be perpendicular to the axis of the bend and extend over the bend.

43. A coaxial connector having a desired characteristic impedance Z, said coaxial connector comprising:

a center conductor having a generally cylindrically-shaped body, wherein said conductor body has a selectable outer diameter determined by the characteristic impedance desired for the coaxial connector;

a dielectric member having a predetermined external shape surrounding at least said conductor body of said center conductor, wherein the conductor body is insert molded into the dielectric member; and an outer shell member stamped from a metal of a predetermined thickness and formed around said dielectric member, said outer shell member having a cylindrical portion enclosing and substantially shielding said dielectric member at least around said conductor body of said center conductor;

said characteristic impedance of the coaxial connector being approximately given by:

$$Z = \frac{C}{\sqrt{E}} \log \frac{I.D.}{O.D.}$$

where

Z = the desired characteristic impedance of the coaxial connector,

C = a predetermined constant,

E = a predetermined dielectric constant of at least said dielectric member,

I.D. = the predetermined inner diameter of the cylindrical-shaped of said outer shell, and O.D. = the selectable outer diameter of the conductor body of said center conductor.

44. The coaxial connector according to claim 43, wherein said coaxial connector includes a plug end adapted for insertion into the receiver of a receptacle end connector, and wherein said center conductor includes a fork-shaped receiver being dimensioned to a receive a standard-sized prong of the receptacle connector.

45. The coaxial connector according to claim 43, wherein said coaxial connector includes a receptacle end adapted for receiving a plug end connector, and wherein said center by a standard-sized fork-shaped receiver of the plug connector.

46. The coaxial connector according to claim 43, wherein said center conductor is stamped and formed from a sheet metal blank.

47. The coaxial connector according to claim 43, wherein said center conductor includes a solder cup, said solder cup being dimensioned to receive a signal conductor of a coaxial cable of the desired impedance.

48. The coaxial connector according to claim 43, wherein said outer shell includes a bendable tail portion attached to said outer shell, said tail portion having a bendable flap extending from each side which ends in a bendable tab.

49. The coaxial connector according to claim 48, wherein said tail portion includes a portions having substantial bends and having stiffening ribs which are constructed and arranged to be perpendicular to the axis of the bend and extend over the bend.

50. The coaxial connector according to claim 43, wherein the characteristic impedance of the connector is greater than 50 ohms.

51. The coaxial connector according to claim 43, wherein said inner diameter of the cylindrical portion of the outer shell and the outer diameter of the middle body portion of said center conductor are formed within such a tolerance that results in an impedance variation for the connector of ±0.5 ohms.

52. The coaxial connector according to claim 43, further comprising a ferrule which can be deformably crimped over said cylindrical portion of said outer shell, said ferrule having slots for locating it over the rear portion of said outer shell, said outer shell having integrally-formed outwardly extending tabs adapted to be received in said slots of said ferrule to stop it at a predetermined position.

53. The coaxial connector according to claim 43, wherein said outer shell includes a tail portion having a plurality of integrally-formed terminal legs, and wherein said center conductor has an integrally-formed terminal leg portion.

54. The coaxial connector according to claim 53, wherein said terminal legs are adapted for through-hole mounting on a printed circuit board.

55. The coaxial connector according to claim 53, wherein said terminal legs are adapted for surface mounting on a printed circuit board.

56. The coaxial connector according to claim 43, wherein the outside diameter of said outer shell has dimensions adapted for mounting in a coaxial contact bore of a combination connector housing.

57. The coaxial connector according to claim 56, wherein said combination connector housing is a D-subminiature combination connector housing.

58. The coaxial connector according to claim 56, wherein said combination connector housing is a 41612 DIN combination connector housing.

59. The coaxial connector according to claim 56, wherein said outer shell includes at least three integrally-formed spring latches being of equal angular spacings around the periphery of said outer shell and being arranged for centering the connector in said bore, and further includes at least two stops, each substantially centered between two of said spring latches, which cooperate with said coaxial contact bore to lock the connector in and release the connector from the coaxial contact bore.

60. The coaxial connector according to claim 43, wherein said outer shell includes spacer means for supporting said dielectric member within said outer shell a predefined distance away from the inner surface of the shell to define a generally cylindrical air space between said dielectric member and said outer shell.

61. The coaxial connector according to claim 60, wherein said spacer means includes at least three spacer means elongated along the central axis of said dielectric member and disposed at equal angular increments.

62. The coaxial connector according to claim 60, wherein at least one of said spacer means is formed by cutting a tab in said outer shell and bending said tab inwardly.

63. The coaxial connector according to claim 60, wherein at least one of said spacer means is formed by deforming said outer shell inwardly to produce an indentation.

* * * * *

UNITED STATES PATENT AND TRADEMARK OFFICE

CERTIFICATE OF CORRECTION

PATENT NO. : 5,055,068

DATED : October 8, 1991

INVENTOR(S) : Machura, et al.

It is certified that error appears in the above-identified patent and that said Letters Patent is hereby corrected as shown below:

On the title page: [73]Assignee's "Wooddale" should read --Wood Dale--.

under Related U.S. Application Data, "1989, abandoned" should read --1989, now U.S. Patent No. 5,060,373.--.

Column 1, lines 10-11, "now abandoned" should read --now U.S. Patent No. 5,060,373,--.

Column 1, line 40, "same-connector" should read --same connector--.

Column 3, line 22, "invention to" should read --invention is to--.

Column 4, line 16, "stamped nd" should read --stamped and--.

Column 4, line 17, "shell Integral" should read --shell. Integral--.

Column 8, line 61, "times 52, 53" should read --tines 52, 53--.

Column 9, line 8, "conductors 56" should read --conductor 56--.

Column 10, lines 35-36, "has a end" should read --has an end--.

Column 16, line 46, "articular" should read --particular--.

UNITED STATES PATENT AND TRADEMARK OFFICE

CERTIFICATE OF CORRECTION

PATENT NO. : 5,055,068

DATED : October 8, 1991

INVENTOR(S) : Machura, et al.

It is certified that error appears in the above-identified patent and that said Letters Patent is hereby corrected as shown below:

Column 17, line 28, "is bent is" should read --is bent in--.

Column 18, lines 49-50, "A2-4-A28" should read --A24-A28--.

Column 19, lines 17-18, "desired additional" should read --desired, additional--.

Claim 23, column 23, line 51, "and adapted" should read --end adapted--.

Claim 43, column 25, lines 40-41, "cylindrical-shaped of" should read --cylindrical portion of--.

Claim 44, column 25, line 48, "dimensioned to a" should read --dimensioned to--.

Claim 45, column 25, line 54, "center by a" should read --center conductor includes a prong end dimensioned to be received by a--.

Signed and Sealed this

Fifth Day of October, 1993

Bruce Lehman

*Attest:*

BRUCE LEHMAN

*Attesting Officer*

*Commissioner of Patents and Trademarks*